US005395248A

United States Patent [19]

Kinoshita et al.

[11] Patent Number: 5,395,248

[45] Date of Patent: Mar. 7, 1995

[54] CONNECTOR COMPRISING PLUG AND SOCKET WHICH ARE ROTATABLY ENGAGED WITH EACH OTHER

[75] Inventors: Yoshichika Kinoshita; Hiroyuki Wada; Kanichiro Shoji, all of Ibaraki, Japan

[73] Assignee: Mitsumi Electric Co., Ltd., Japan

[21] Appl. No.: 213,978

[22] Filed: Mar. 16, 1994

Related U.S. Application Data

[63] Continuation of Ser. No. 738,234, Jul. 30, 1991, abandoned.

[30] Foreign Application Priority Data

| | | | |
|---|---|---|---|
| Jul. 31, 1990 | [JP] | Japan | 2-81426 U |
| Aug. 31, 1990 | [JP] | Japan | 2-92285 U |
| May 28, 1991 | [JP] | Japan | 3-38551 U |
| May 28, 1991 | [JP] | Japan | 3-38552 U |
| May 30, 1991 | [JP] | Japan | 3-40024 U |

[51] Int. Cl.[6] ..... H01R 39/02

[52] U.S. Cl. ..... 439/31

[58] Field of Search ..... 439/31

[56] References Cited

U.S. PATENT DOCUMENTS

| | | | |
|---|---|---|---|
| 4,715,819 | 12/1987 | Iwasa et al. | 439/31 |
| 4,755,143 | 7/1988 | Enomoto et al. | 439/31 |
| 4,850,882 | 7/1989 | Yu | 439/31 |
| 4,863,387 | 9/1989 | Snaper et al. | 439/31 |
| 5,174,761 | 12/1992 | Kodaira | 439/31 |

*Primary Examiner*—Eugene F. Desmond

*Attorney, Agent, or Firm*—Andrus, Sceales, Starke & Sawall

[57] ABSTRACT

A connector includes a first member, a second member which is rotatably coupled to the first member, a first contact which is provided for a surface of the first member opposite to the second member, and a second contact, provided for a surface of the second member opposite to the first member, which is in contact with the first contact, the first contact and the second contact being relatively slid so that an elèctric connection can be maintained when the first member and said second member are relatively rotated.

14 Claims, 34 Drawing Sheets

93

CONNECTOR COMPRISING PLUG AND SOCKET WHICH ARE ROTATABLY ENGAGED WITH EACH OTHER

This application is a continuation of application Ser. No. 07/738,234 filed Jul. 30, 1991, now abandoned.

BACKGROUND OF THE INVENTION

The present invention relates generally to connectors, and more particularly to a connector comprising a plug and a socket which are rotatably engaged with each other.

A lap-top type personal computer 3 comprises, as shown in FIG. 1, a display 1 and a body 2 which are rotatably engaged with each other. When the computer is not used, the display 1 is folded with the body 2 so that the computer can be easily carried.

In a conventional personal computer 3, the display 1 is connected to the body 2 via a cable 4, as shown in FIG. 2. The display 1 is rotatably supported by the body 2, and the cable 4, inserted into a rotating shaft, electrically connects the display 1 to the body 2.

Connectors 6 to 8 are respectively connected to both ends of the cable 4. These connectors 6 to 8 are connected to the base 9 at the display side and the base 10 at the body side via the connectors 11 to 13.

However, the above conventional construction has the following disadvantages. That is, since 20 to 50 cables are needed between the display 1 and the body 2, it is troublesome to connect the cable 4 to the respective connectors, such as the plug connectors 6 to 8, and to the socket connectors 11 to 13. In addition, since many connectors 6 to 8, 11 to 13 are needed, the number of lines and the production cost of the computer respectively become increased. Furthermore, since a hinge means for rotatably supporting the display 1 and the body 2 is needed in addition to means for electrically connecting the display to the body 2, the construction of the personal computer 3 becomes complicated.

SUMMARY OF THE INVENTION

Accordingly, it is a general object of the present invention to provide a novel and useful connector in which the above disadvantages are eliminated.

Another object of the present invention is to provide a relatively inexpensive connector wherein a plurality of contacts mounted on a plug and a socket which are relatively rotatable with each other can be definitely electrically connected to each other.

A more specific object of the present invention is to provide a connector in which a plug contact and a socket contact are movably provided to keep an electrical connection therebetween.

According to the present invention, a plurality of the plug contacts and the socket contacts are simultaneously connected to each other by engaging the plug with the socket. Therefore, each plug contact and the socket contact can be easily connected and a plurality of terminals can be electrically connected in only one connector. In addition, the connector may function as a hinge.

By the way, a conventional method for dip-soldering-connecting each end of each contact to the base of the body is generally used when each plug contact and each socket contact are respectively connected to a base of the display and a base of the body.

However, the conventional dip soldering connection method which rigidly fixes each member has the following disadvantages. That is, when this connector is used for the personal computer 3, the plug and the socket are assembled after the socket and the plug are respectively attached to the display 1 and the body 2 of the personal computer 3. In this case, it is necessary to absorb an assembly error of another part of the personal computer 3 by a connector. Thus, the connector often gets damaged.

Therefore, still another object of the present invention is to provide a connector having a mechanism in which the connector is prevented from getting damaged by an assembly error.

Still more specific object of the present invention is to provide a connector having a mechanism into which a card edge connector can be inserted at a part to be connected to an external circuit in at least one of a plug and a socket. According to the above mechanism, plug contacts and socket contacts can be connected by inserting the card edge connector base of a connector external circuit via the card edge connector mechanism while the plug and the socket are being coupled to each other. Since an assembly error is corrected by the part into which the card edge connector is inserted, the connector is prevented from getting damaged.

By the way, an assembly error is corrected if the above mechanism is provided, as shown in FIG. 3, between a base 19 and a connection part 20 of the connector with an idle space "d". However, the above connector is advantageous. That is, if the connection part is deformed or external vibration is applied to the connection part, an offset between the base and the connector often occurs and thus the stable connection is prevented.

Accordingly, further object of the present invention is to provide a connector having a mechanism in which a stable connection can be always maintained.

The further more specific object of the present invention is to provide a connector in which a connection part to be connected to an external circuit is inserted into at least one of the plug and the socket with an idle space.

According to the present invention, since the connection part is inserted into the connector with an idle space, even if an offset occur, the offset is absorbed in the idle space, so that stable connection of the contacts can be always maintained.

By the way, when this connector is used for the personal computer 3, since the socket and plug are respectively attached to the display 1 and the body 2 of the personal computer 3, it is difficult to extract one of them. Therefore, it is impossible that the display 1 and the body 2 are wholly assembled while the personal computer 3 is divided into the display 1 and the body 2 and combined after they are respectively assembled.

Another object of the present invention is to provide a connector having a mechanism in which a socket and a plug can be respectively engaged/separated to each other while they are being assembled.

The more specific object of the present invention is to provide a connector in which the plug and the socket respectively have notch parts at a hinge part so as to be engaged/separated to/from each other at a predetermined angle.

According to the present invention, the plug and the socket can be engaged/separated to each other at a predetermined angle.

By the way, miniature and thin personal computers are increasingly required.

Still another object of the present invention is to provide a connector having a mechanism which does not hinder a personal computer using the connector from being miniaturized and made thinner.

The still more specific object of the present invention is to provide a connector in which a contact of at least one of a plug and the socket has an overhung and curved shape.

According to the present invention, a small connector having an elongated connection part can be provided. Therefore, a miniature connector which makes the connection part function as a flat spring can be provided.

By the way, an inexpensive personal computer has been recently required. Accordingly, an inexpensive connector has been required.

Further object of the present invention is to provide a connector having a simple mechanism in which the connector can be easily assembled.

Further more specific object of the present invention is to provide a connector having an element which serves a plurality of functions.

According to the present invention, the number of elements of the connector can be decreased since a specific element serves a plurality of functions.

Other objects and further features of the present invention will become apparent when read in conjunction with the accompanying drawings.

DESCRIPTION OF THE PREFERRED EMBODIMENTS

Figure 1:
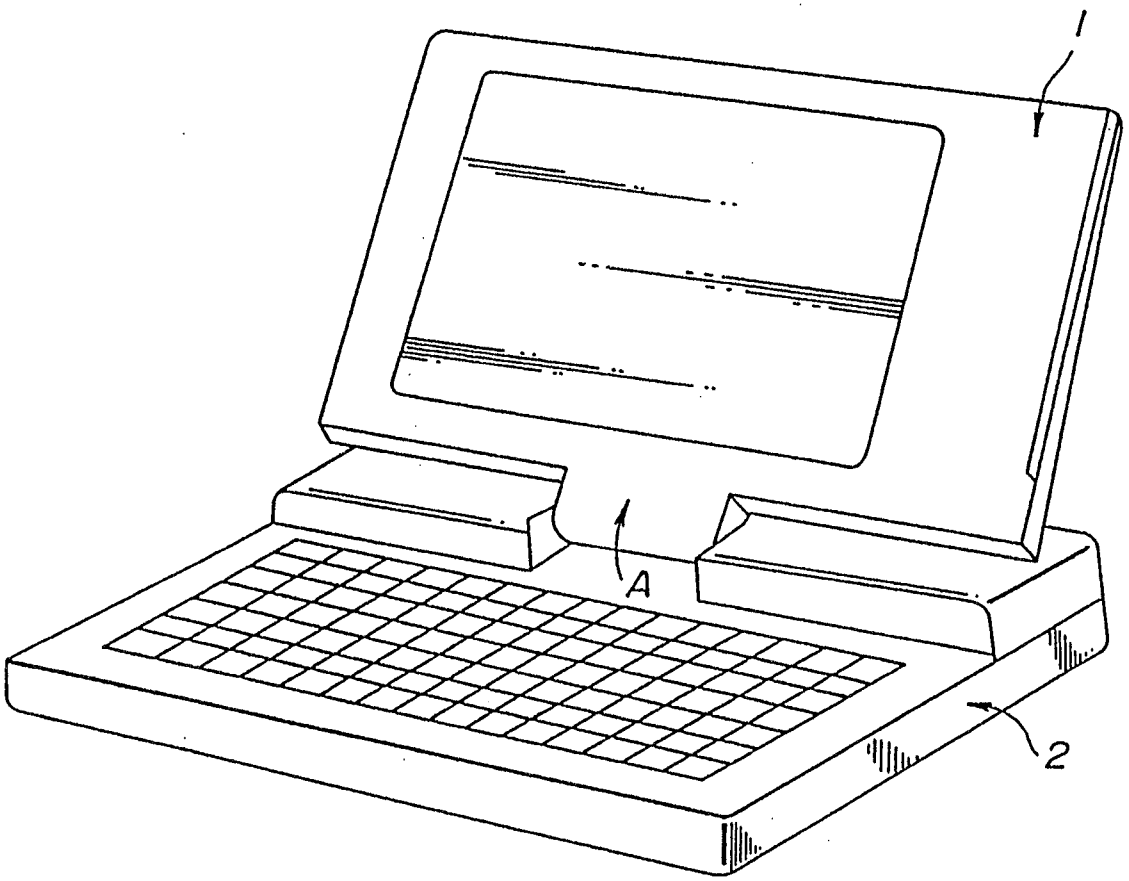
FIG. 1 PRIOR ART
FIG. 1 shows a perspective view of the personal computer to which the present invention is applied.
Figure 2:
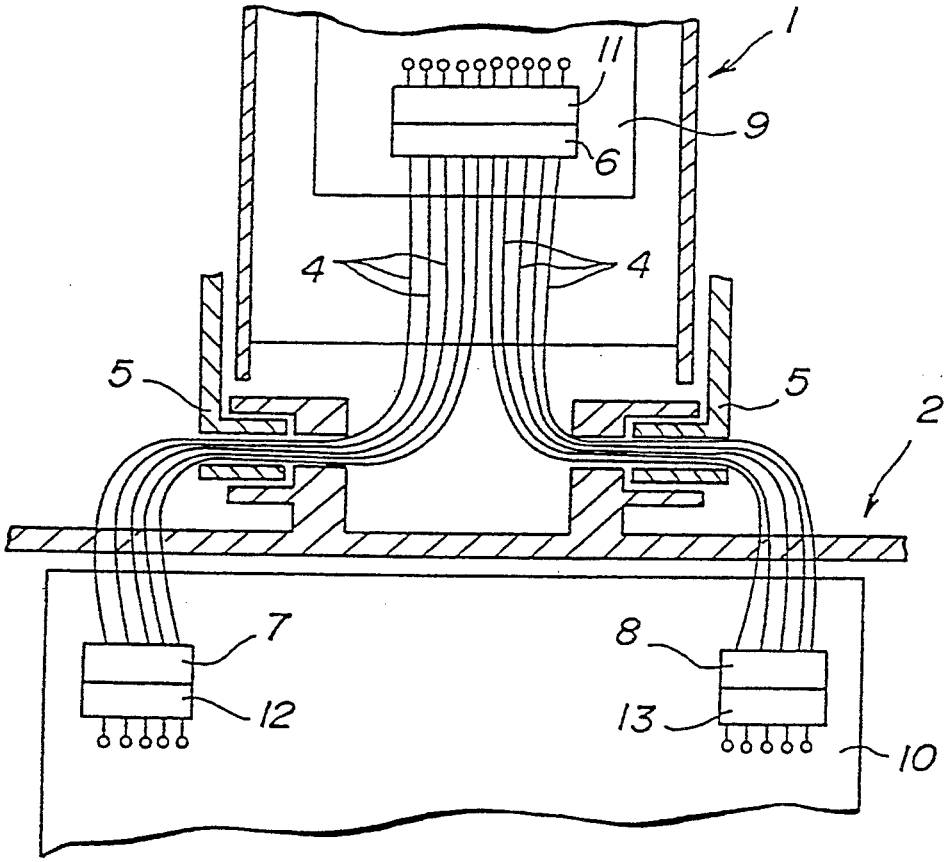
FIG. 2 PRIOR ART
FIG. 2 shows an example of a conventional construction.
Figure 3:
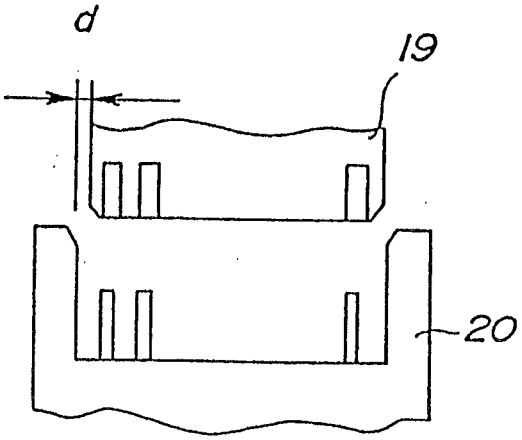
FIG. 3 shows an example of a plan view of a part into which a card edge connector is inserted of the first embodiment according to the present invention.
Figure 6:
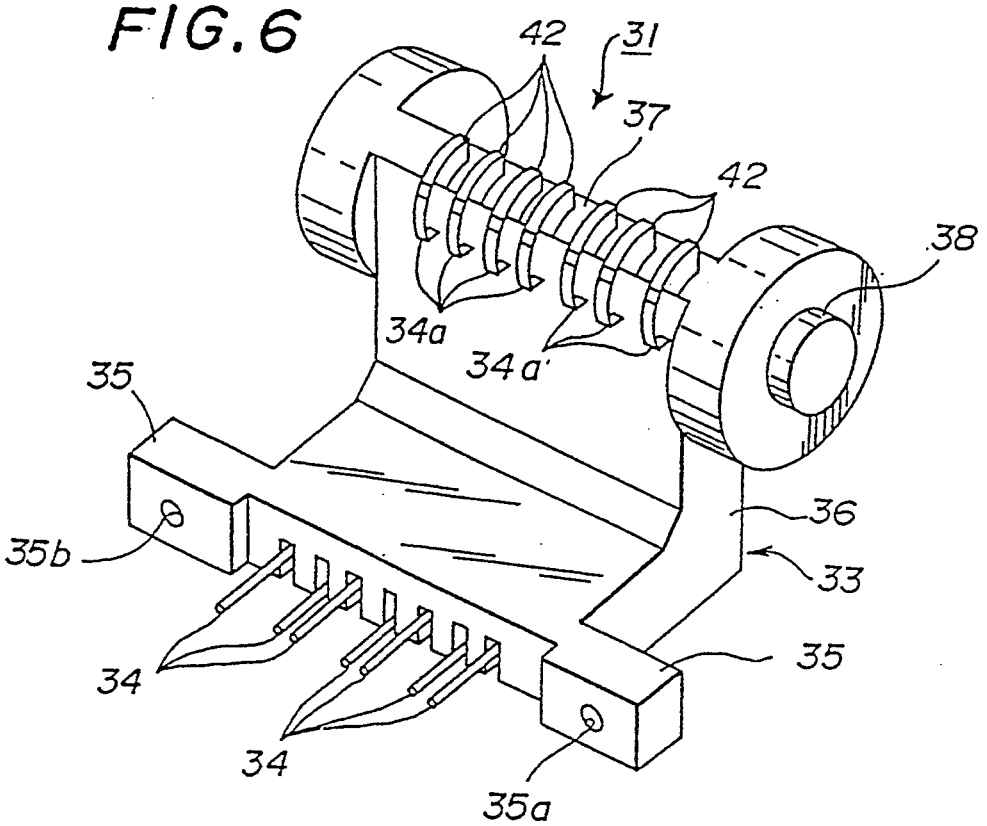
FIG. 6 shows a perspective view of a plug of the first embodiment according to the present invention.
Figure 7:
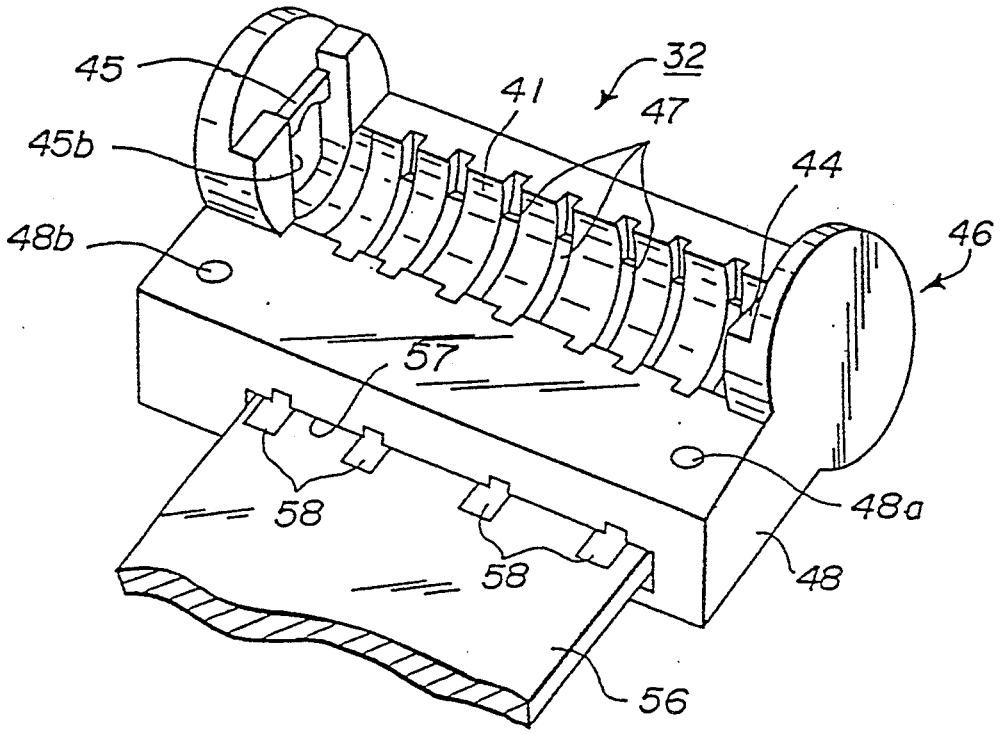
FIG. 7. shows a perspective view of a socket of the first embodiment according to the present invention.

FIGS. 4A through 4D show a plug 31 of a connector 30 (see FIG. 10) of a first embodiment according to the present invention. FIGS. 5A through 5E show a socket 32 of a connector 30. FIG. 6 shows a perspective view showing a rough construction of the plug 31. FIG. 7 shows a perspective view showing a rough construction of the socket 32. This connector 30 electrically connects the plug 31 and the socket 32 and has a hinge construction, and it is used for a connection part (shown A in FIG. 1) between a display 1 and a body 2 in a personal computer 3.

The plug 31, fixed on the body 2 of the personal computer 3, comprises a plug mold 33 and a plurality of (20 to 50) plug contacts 34. The plug mold 33, made of a resin, comprises a fixed part 35, a standing part 36, an arc-convex part 37, and shaft parts 38 and 39.

The fixed part 35 has a pair of holes 35*a* and 35*b* into which screws (not shown) are inserted in order to fix the plug 31 on a base (not shown) in the body 2. In addition, the back surface part 35*c* of the fixed part 35 has a guide groove 40 which holds and guides a side end of a body of a plug contact 34.

Figure 4A:
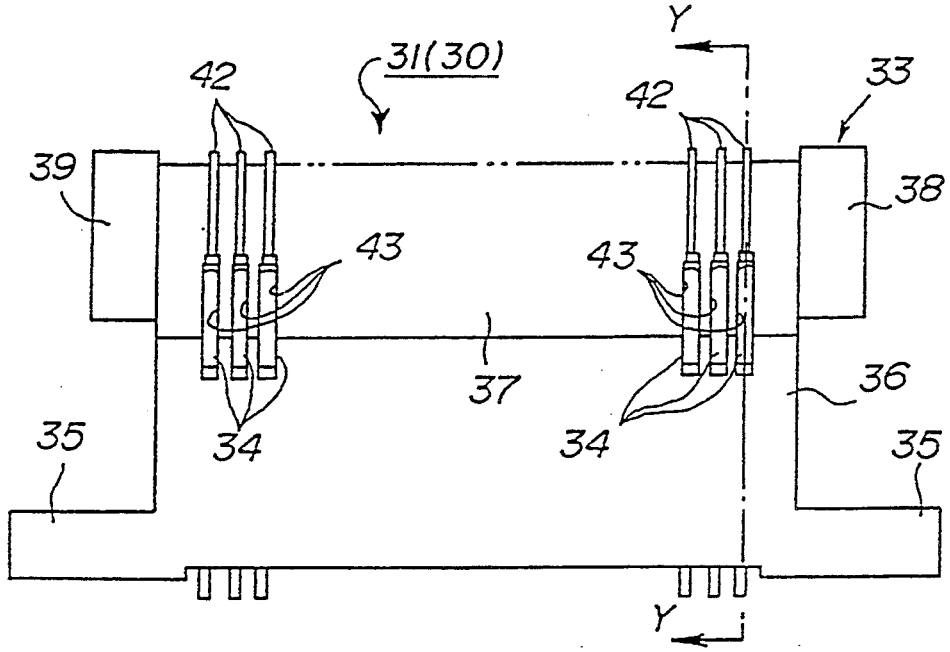
FIGS. 4A to 4D respectively show a plan view, front view, bottom view and side view of a plug of a first embodiment according to the present invention.
Figure 4B:
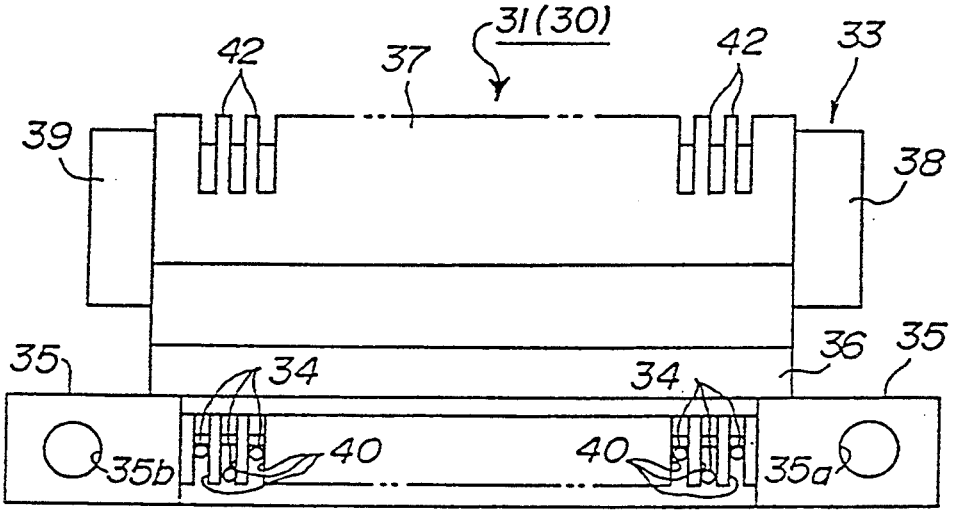
Figure 4C:
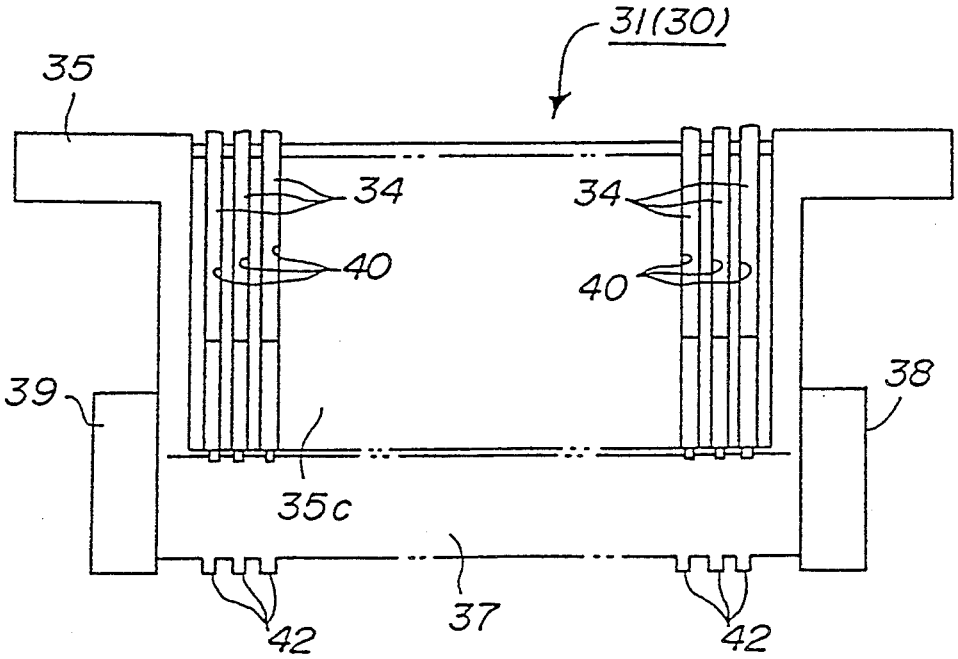
Figure 4D:
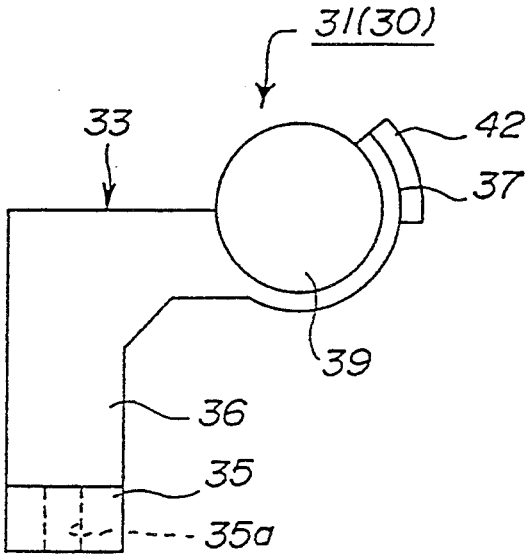

The standing part 36 has an L-shape, as shown in FIG. 4D, has an arc-convex part 37 at an end opposite to the fixed part 35 so that a curvature of the arc-convex part 37 can be opposite to the arc-concave part 41 provided for the socket 32. This arc-convex part 37 has a positioning convex part 42 and a contact holding groove 43 (not shown in FIG. 6).

Figure 8:
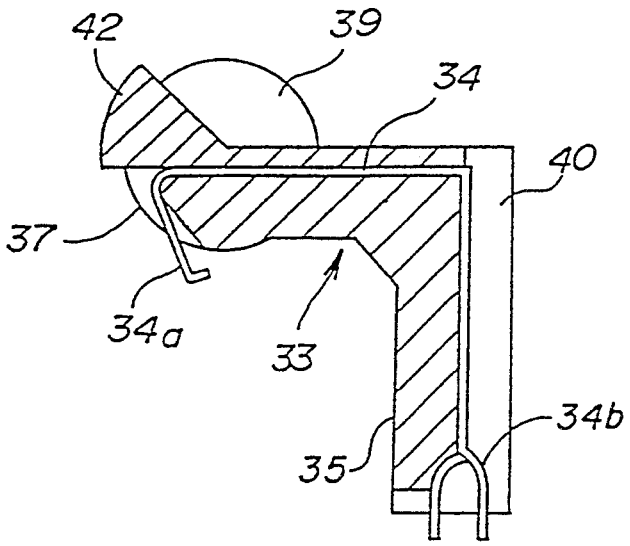
FIG. 8 shows a transverse section of a plug of the first embodiment according to the present invention.

FIG. 8 shows a sectional view taken along a line Y—Y shown in FIG. 4A. The positioning convex part 42 and the contact holding groove 43 are respectively formed on the same surface. In addition, the positioning convex part 42 is formed at an upper part in the same drawing, and the contact holding groove 43 is continuously provided on the positioning convex part 42. The end at the arc-convex side of the plug contact 34 is bent along the contact holding groove 43, and a connection terminal 34*a* is provided in the groove 43. In addition, an end at the fixed side is bent along the guiding groove 40 formed in the fixed part 35, and a part thereof projects into the fixed part 35, which is called as a soldered terminal 34*b*. This soldered terminal 34*b* is soldered on the base in the body 2 of the personal computer 3. Incidentally, the plug contact 34 is fixed by being inserted and molded into the plug mold 33.

The shafts 38 and 39 are formed at both ends of the arc-convex part 37. These shafts 38 and 39 are rotatably engaged with the bearing parts 44 and 45 formed on the socket 32, so that the plug 31 and the socket 32 construct a hinge and the socket 32 can be pivotally engaged with the plug 31. Incidentally, FIG. 5E shows a sectional view taken along Z—Z line in FIG. 5A.

Next a description will now be given of the socket 32 into which a card edge connector can be inserted with reference to FIGS. 5A–E and 7.

The socket 32, fixed on the display 1 of the personal computer 3, comprises a socket mold 46 and a socket contacts corresponding to the plug contacts 34. The socket mold 46, made of resin, comprises an arc-convex part 41, bearing parts 44 and 45 and a card inserting part 48.

The arc-concave part 41 has a curvature opposite to the arc-convex 37 formed in the plug 31 with a predetermined idle space, and the socket contact 47 is provided along the curved shape. These socket contacts 47 are fixed on the socket mold 46 by means of an inserting mold, and the provided pitch is predetermined so that it can be equal to that of the plug contact 34 provided for the arc-convex part 37.

The arc-concave part 41 has a plurality of positioning brims 49 so as to hold respective provided positions of the socket contact 47. A distance between these adjacent pairs of positioning brims 49 is predetermined so that the positioning convex parts 42 formed on the plug 31 are movably engaged with the brims 49 to be fixed and connection terminals 34*a* of the plug contact 34 is projected into the brims 49.

Figure 5A:
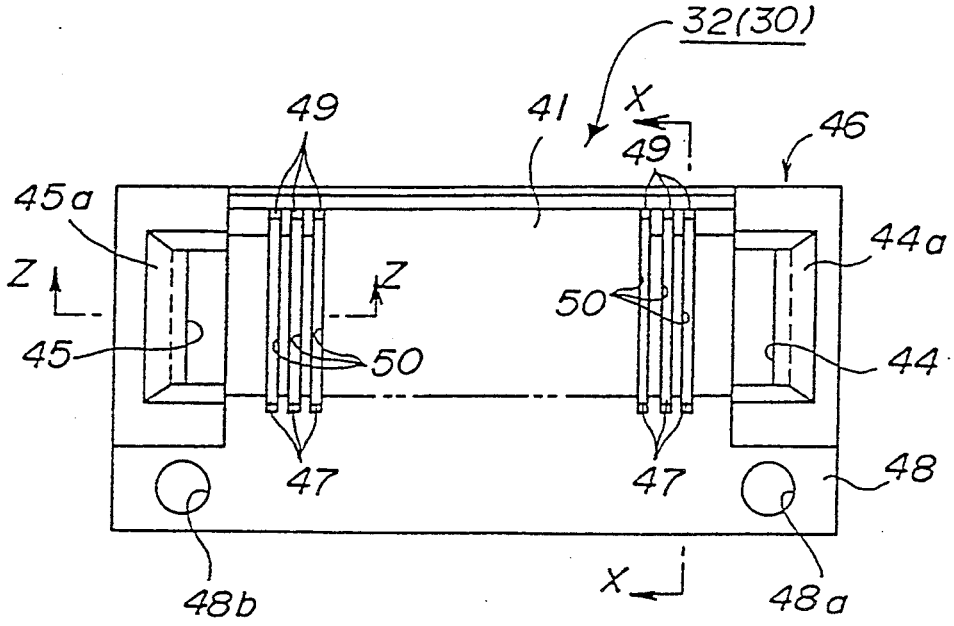
FIGS. 5A to 5E respectively show a plan view, front view, bottom view, side view of a socket of the first embodiment according to the present invention and a longitudinal section of a bearing part.
Figure 5B:
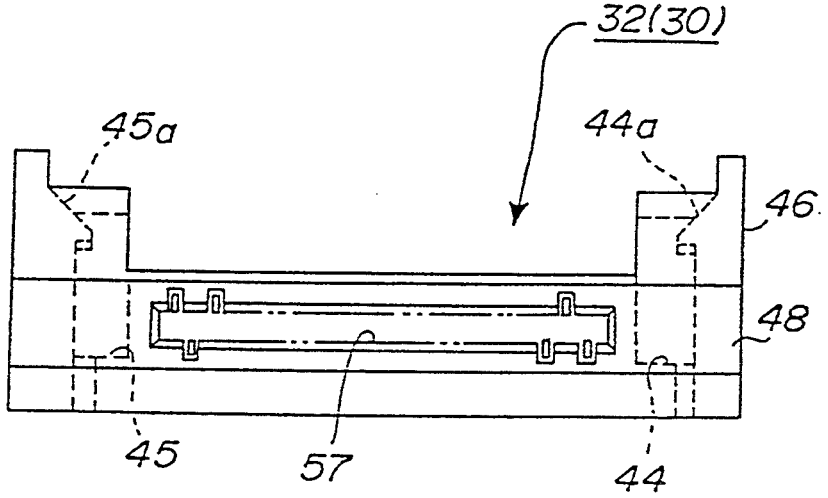
Figure 5C:
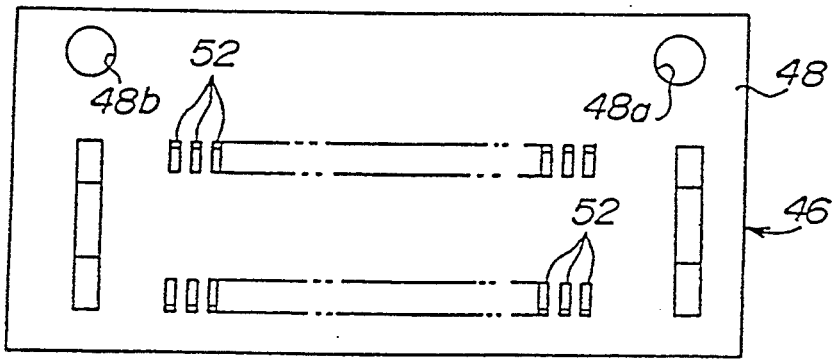
Figure 5D:
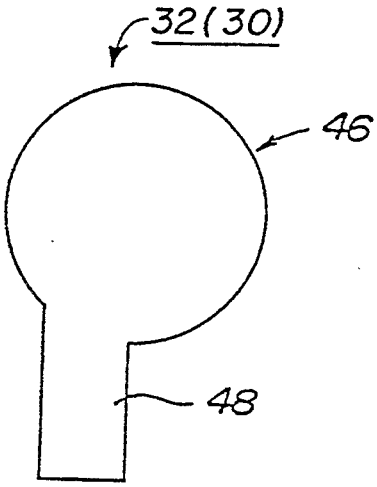
Figure 5E:
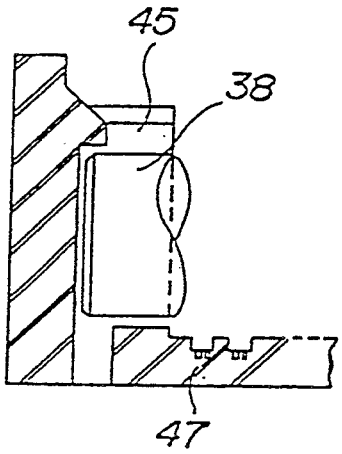
Figure 9:
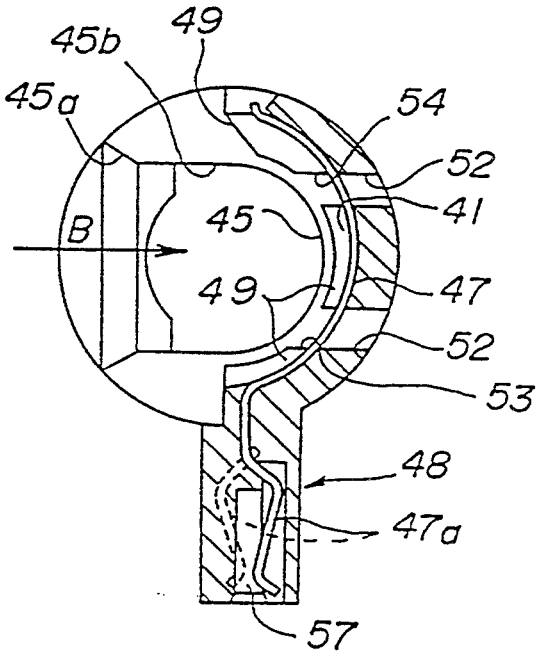
FIG. 9 shows a transverse section of the socket of the first embodiment according to the present invention.

As shown in FIG. 9 and 5A, the bearing parts 44 and 45 are formed at both ends of the arc-concave part 41 and these shafts 38 and 39 are respectively inserted in a direction B into concave parts 44*b* and 45*b* on the inside wall surface. The taper parts 44*a* and 45*a* are respectively formed at the upper part of the bearing parts 44 and 45 so that the shafts 38 and 39 can be easily inserted.

Figure 10:
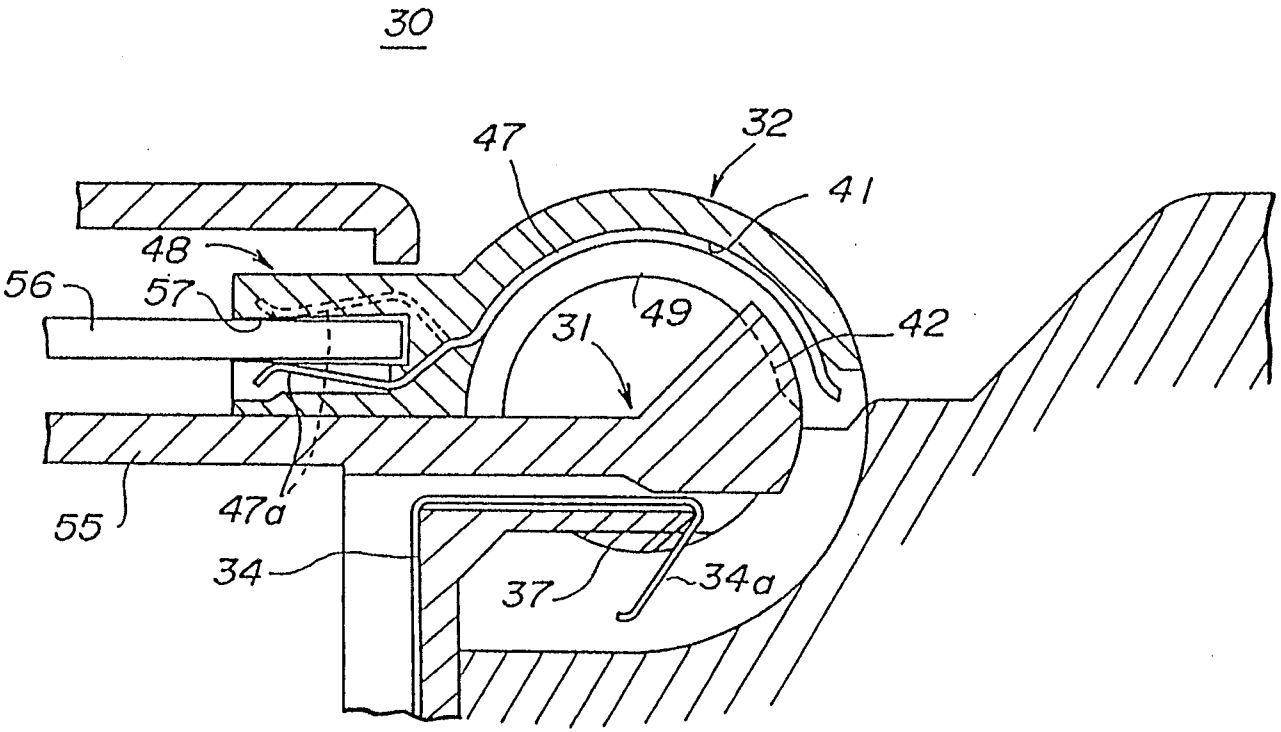
FIG. 10 shows a transverse section of a connector of the first embodiment according to the present invention which is used for a personal computer with a display closed.
Figure 11:
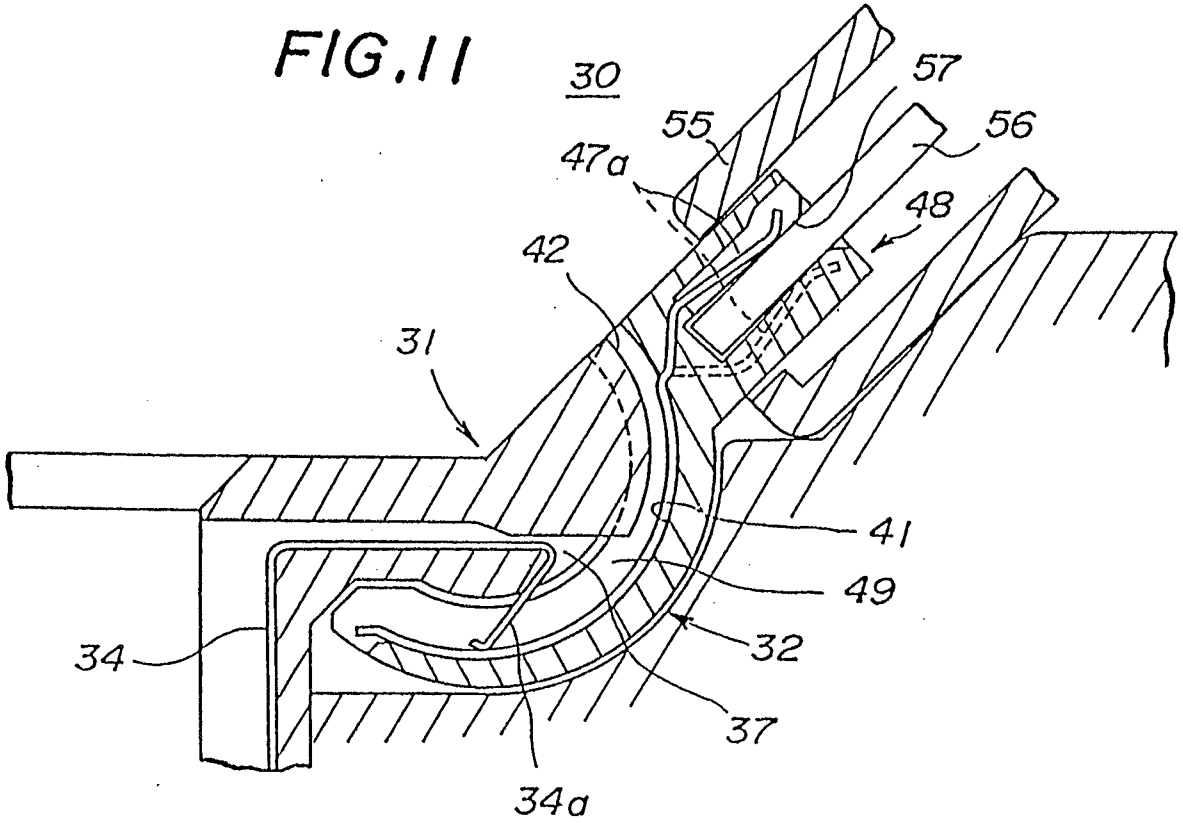
FIG. 11 shows a transverse section in which the display of the FIG. 10 is opened.

The card inserting part 48 has a brim shape extending from arc-concave part 41 towards sides, on which a pair of holes 48*a* and 48*b* are provided. Since these holes 48*a* and 48*b* are screwed on a case 55 of the display 1, as shown in FIGS. 10 and 11. Incidentally, the numerals 52 to 54 respectively denote jig insertion holes in which jigs positioning the socket contacts 47 at a predetermined position are inserted, when the socket contact 47 is inserted and molded into the socket mold 46.

Figure 12:
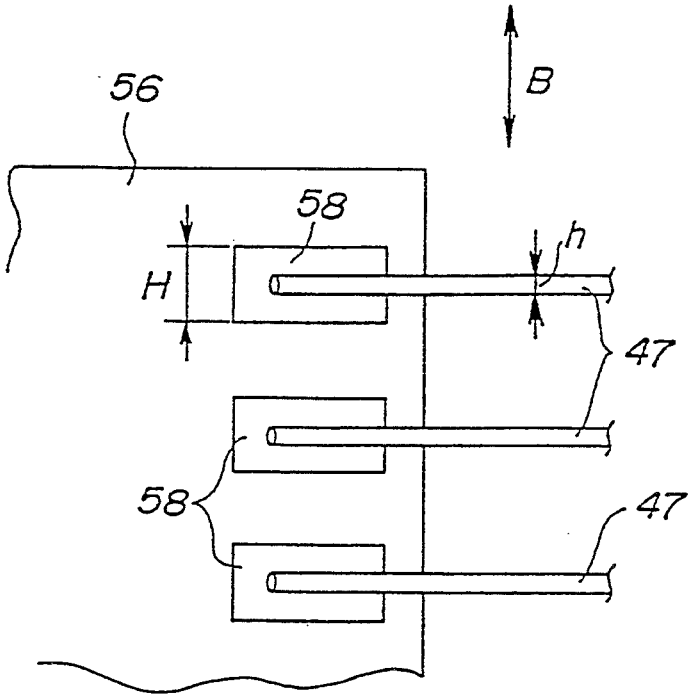
FIG. 12 shows an enlarged view of a connection condition of a socket contact and a lead of a card of the first embodiment according to the present invention.
Figure 13A:
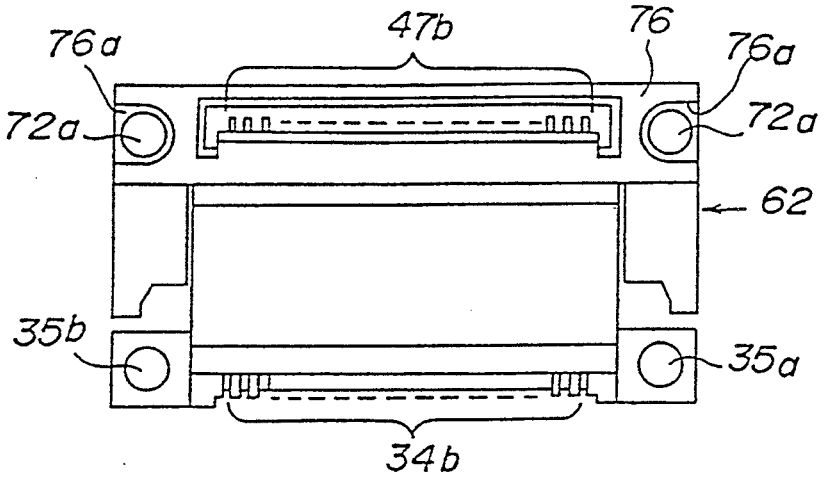
FIGS. 13A to 13D respectively show a front view, bottom view, side view and transverse sectional view of a second embodiment according to the present invention.
Figure 13B:
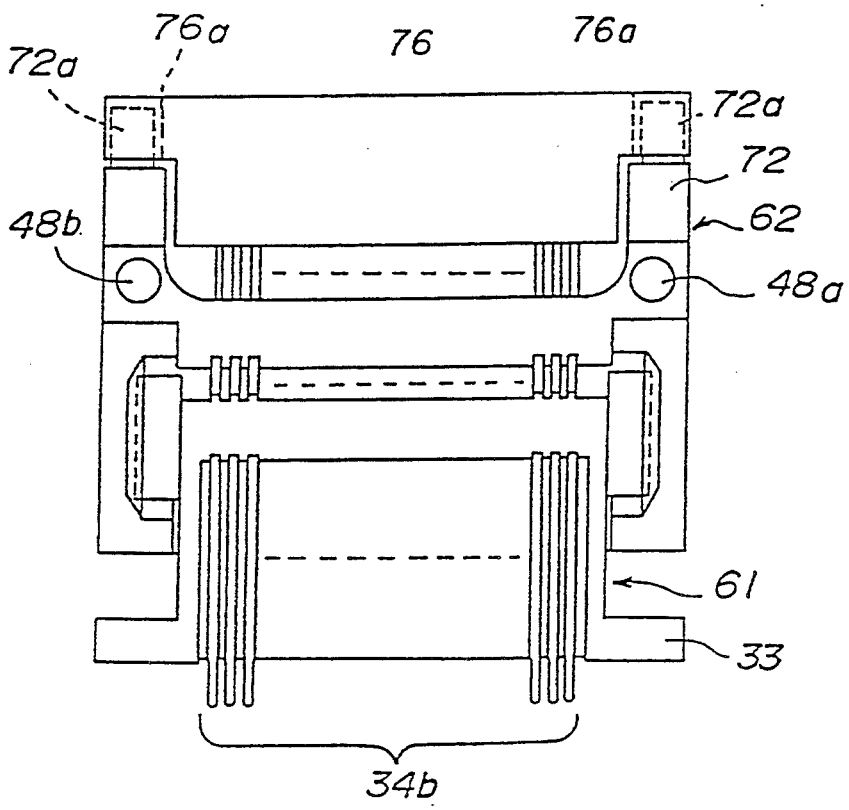
Figure 13C:
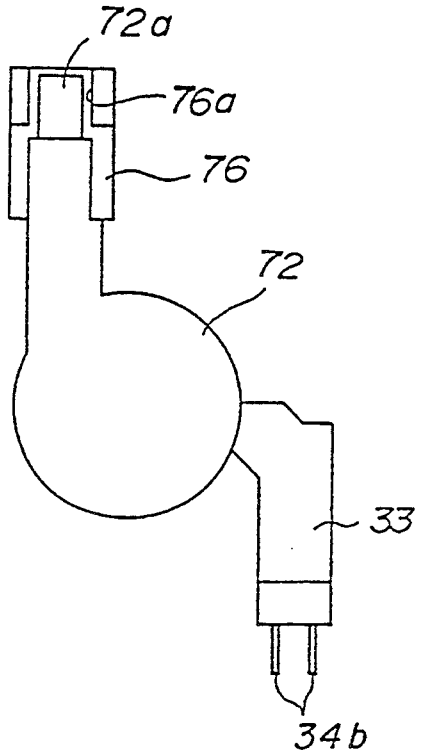
Figure 13D:
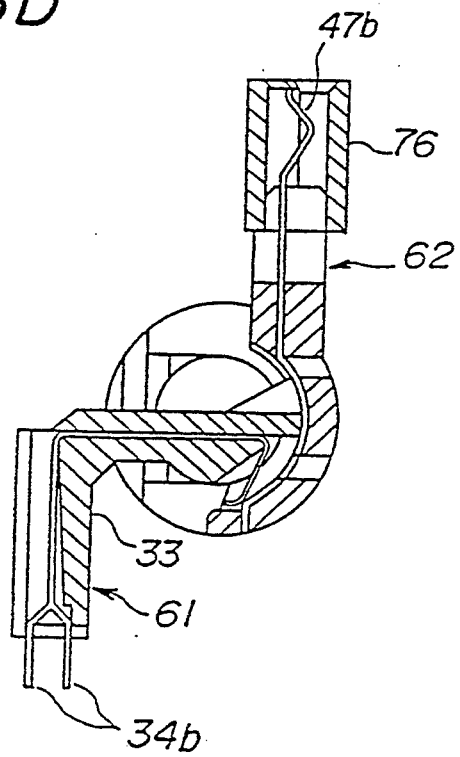

The card insertion part 48 also has an insertion opening 57 into which a base (card) mounted in the display 1 is inserted. Since ends 47*a* of the socket contacts 47 have a contact shape, as shown in FIG. 11, this card insertion part 48 is formed so that the card edge connector can be inserted therethrough. In addition, as shown in FIGS. 7 and 12, leads are provided on the edge of the card 56. The provided pitch of the lead 58 corresponds to that of the socket contact 47. Therefore, once the card 56 mounted in the display 1 is inserted into the insertion opening 57, the display 1 and the connector 30 are electrically connected with each other.

FIG. 12 shows an enlarged view of a connection condition between the socket contact 47 and the lead 58 of the card 56. As shown in the same drawing, the width H of the lead 58 is larger than the width h of the socket contact 47. In addition, the width of the card is smaller than that of the insertion opening 57, so as to be easily inserted. Therefore, the card 56 being inserted into the insertion opening 57 can move in a direction B in FIG. 7. Even if it moves, since the width H is larger than the width h, the socket contact 47 is kept being electrically connected to the lead 58.

Because of the card insertion part 48 into which the card edge connector, i.e. a card edge having connectors, can be inserted, there is an idle space between the card 56 and the card insertion part 48, in other words, between the display and the connector 30. Therefore, even if there occurs an assembly error in a display 1, the idle space between the card 56 and the card insertion part 48 can cancel the error. Thus, assembly error damage to the connector 30 is prevented. In addition, the connector 30 can be attached to the display 1 and the body while it is engaged with the plug 31 and the socket 32. Therefore, the production line can be simplified, and the connector 30 can be shipped from a factory already assembled with the plug and the socket 32.

Next, a description will now be given of the operation of the connector 30 comprising the plug 31 and the socket 32.

FIGS. 10 and 11 show examples in which the connector 30 is applied to the personal computer 3. FIG. 10 shows a body 2 with the display 1 closed, and FIG. 11 shows a body 2 with the display 1 opened.

The connector 30 electrically connects the display 1 and the body 2 by a hinge construction which is comprised by shafts 38 and 39 of the plug 31 pivotally engaged with the bearing parts 44 and 45 of the socket 32 and by a connection between the respective contacts 34 and 37.

As shown in FIG. 12, when the display 1 is closed, the plug contact 34 and the socket contact 47A are separated with each other, so that the electric connection cannot obtained. On the other hand, when the display 1 is rotated clockwise and opened, the personal computer 3 is used as shown in FIG. 13. The shafts 38 and 39 formed on the plug 31 rotates in the respective bearing parts 44 and 45. When the display 1 is opened, as shown in FIG. 11, the plug contact 34 and the socket contact 47A are connected with each other, and the display 1 and the body 2 are electrically connected with each other.

When the connection is made, a plurality of (about 20 to 50) plug contacts 34 and the socket contacts 47 are connected simultaneously. Thus, the respective plug contacts 34 and the socket contacts 47 can be easily connected with each other, and only one connector 30 achieves a multiplicity of electronic connections. In this way, since the cable 4 and plenty of connectors 6 to 8 and 11 to 13 can be omitted, the production cost of the personal computer 3 can be lowered. Moreover, since the connection terminal 34*a* of the plug contact 34 slides in a wide range of socket contact 47 as the socket 32 rotates, a part of the connector 30 can be prevented from being worn away.

Incidentally, the card edge connector may be inserted into the plug 31. In addition, the card edge connector may be inserted into at least one of the plug 31 and socket 32.

According to the invention, since the assembly error is not applied to the connector, the connector can be prevented from getting damaged. Furthermore, a connector, which has been assembled, may be attached at an electroequipment.

Figure 14:
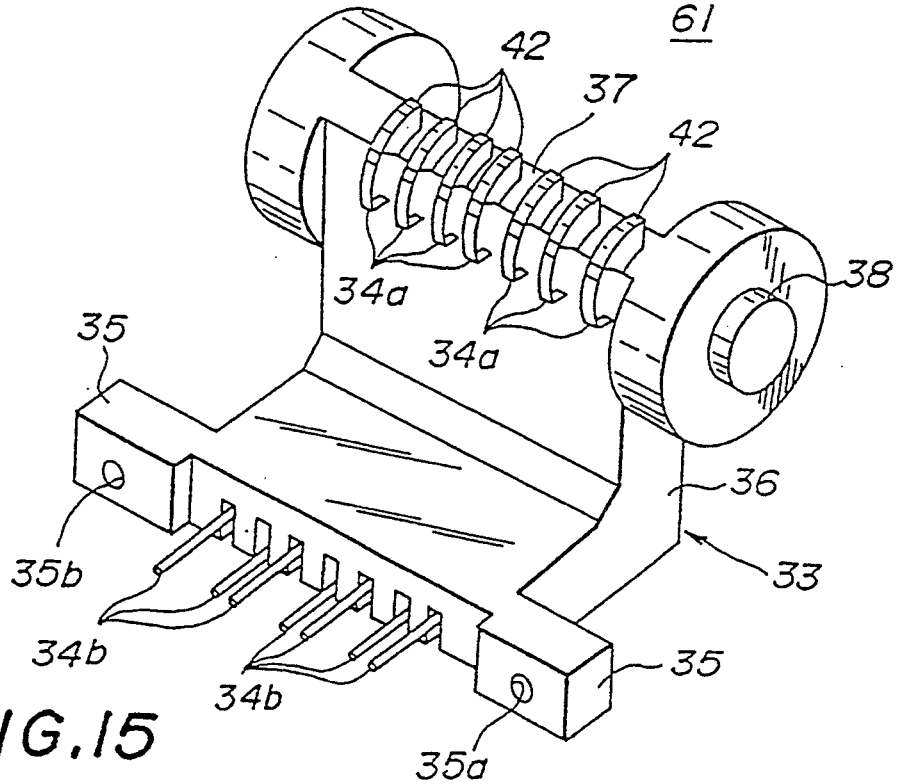
FIG. 14 shows a perspective view of a plug of a second embodiment according to the present invention.
Figure 15:
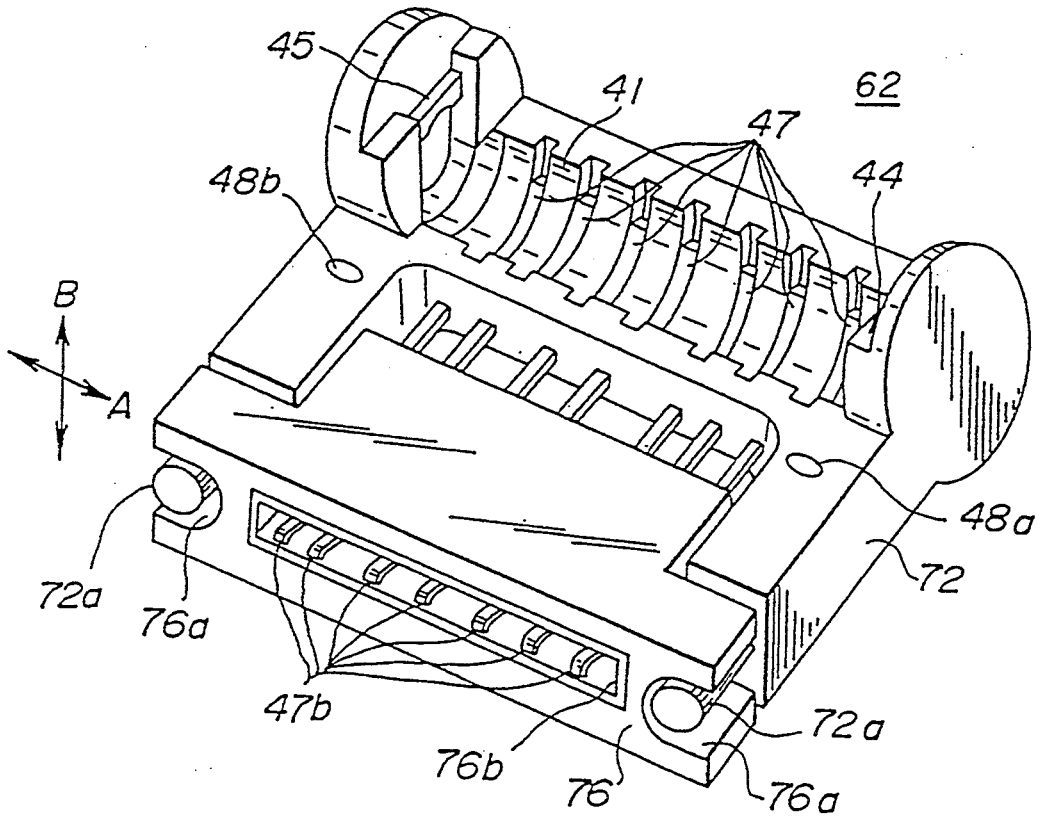
FIG. 15 shows a perspective view of a socket of the second embodiment according to the present invention.
Figure 16:
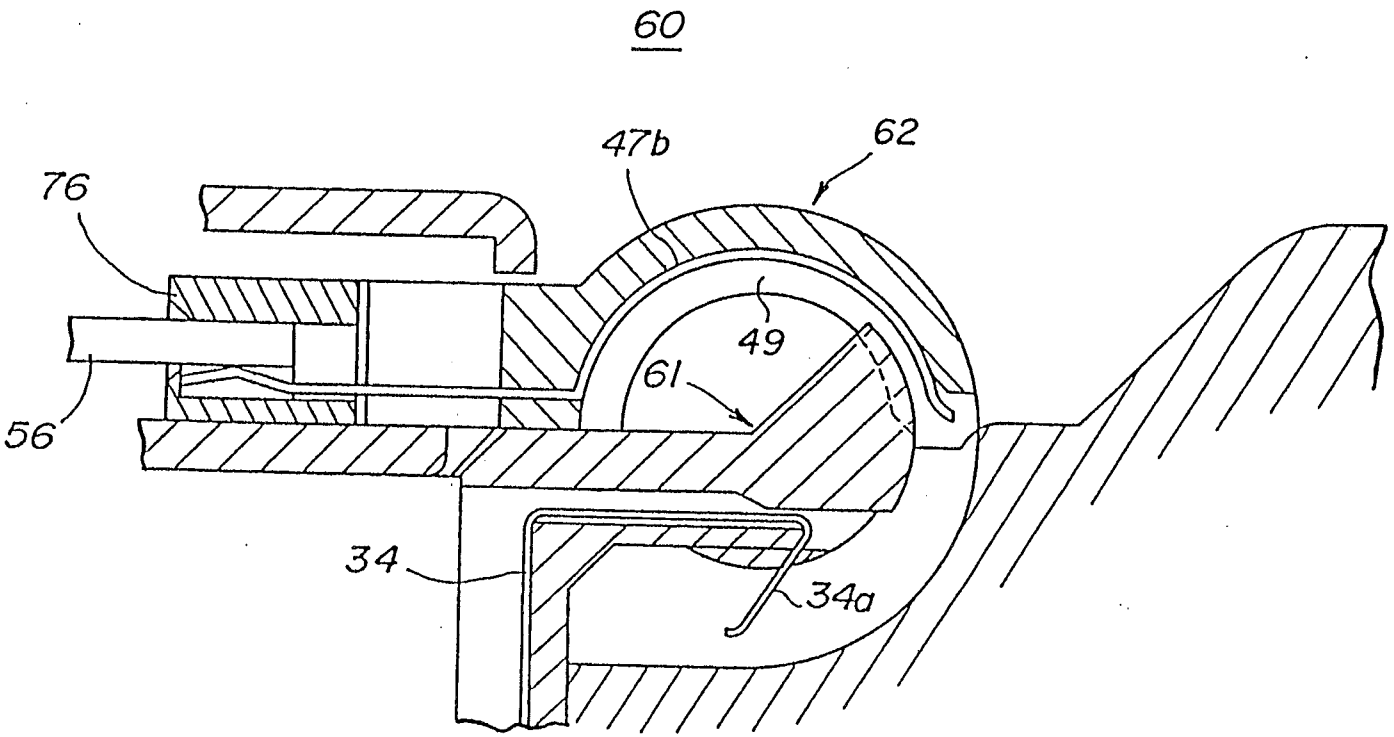
FIG. 16 shows a sectional view of a connector of the second embodiment according to the present invention which is used for the personal computer with the display closed.
Figure 17:
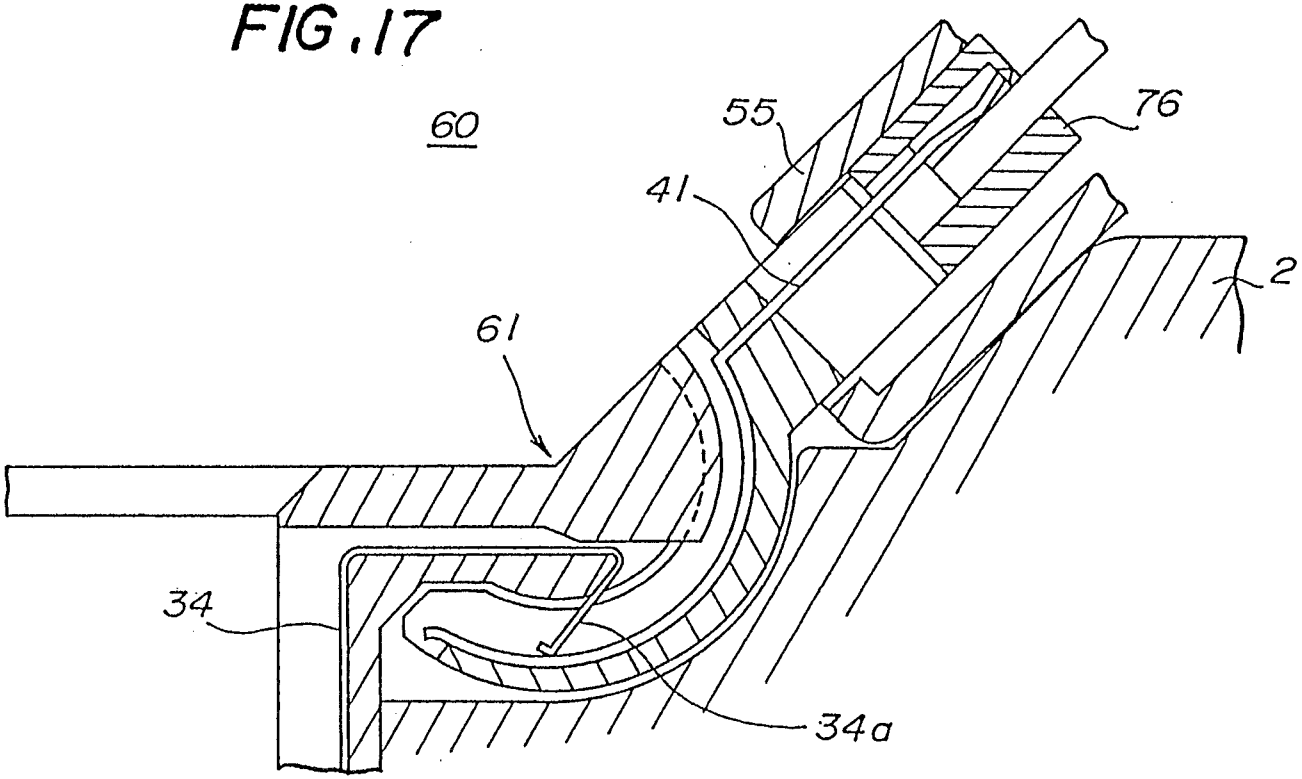
FIG. 17 show a sectional view in which the display of the FIG. 16 is opened.

FIG. 13A to 13D show a connector 60 of the second embodiment according to the present invention, and FIG. 14 shows a plug 61 of the connector 60. FIG. 15 shows a socket 62 of the connector 60. This connector 60, like the connector 30 of the first embodiment, electrically connects the plug 61 and the socket 62 by using a hinge construction made by the plug 61 and the socket 62. The connector 60 may be, for example, used for a connection part shown as an arrow A in FIG. 1 between a display 1 and the body 2 of the personal computer 3.

The plug 61 is fixed on the body 2 of the personal computer 3, and those elements which are the same as corresponding elements of the first embodiment are designated by the same reference numerals, and a description thereof will be omitted.

The socket 62, fixed on the display 1 of the personal computer 3, comprises a socket mold 72 and a socket contacts 47 corresponding to the plug contacts 34. The socket mold 72, made of resin, comprises an arc-concave part 41 and a bearing part 45. The socket mold 72 is engaged with a connection part 76 via an idle space.

Since those elements in the socket 62 without the card insertion part 78 are the same in the socket 32 of the connector 30, those elements in the socket 62 which are the same as corresponding elements in the socket 32 are designated by the same reference numerals, and a description thereof will be omitted.

The connection part 76 is engaged with an end of the socket contact 47 and the socket mold 72. In addition, the connection part 76 has a concave part 76*a*, while the socket mold 72 has a convex part 72*a*. The concave part 76*a* and the convex part 72*a* are engaged with an idle space with each other.

The connection part 76 has an insertion opening 76*b* into which a base (card) mounted in the display 1 is inserted. Each respective end of the socket contact 47*b* has a contact shape and the card edge connector is inserted into the connection part 76. In addition, a lead 58 is provided at the edge of the card 56, and a provided pitch of the lead 58 is equal to that of the socket contact 47. Therefore, only if the card 56 is inserted into the insertion opening 76*b*, the display 1 and the connector 60 can be electrically connected with each other.

Since the connection part 76 is engaged with the socket mold 72 at one end of the flat plate socket contact 47, it can be freely move in a range restricted by the convex part 72*a* and the concave part 76*a* in directions A and B in FIG. 15.

Therefore, even if the insertion opening 76*b* is slightly apart from the card 56, the card may be easily inserted into the connection part 76 since the connection part 76 moves in accordance with the position of the card 56.

In addition, since the width of the insertion opening 76*b* of the connection part 76 is made approximately equal to that of the card 56 and the card 56 can correspond to the insertion opening 76*b*, even if there is an error during assembly, the card 56 can be connected to the socket contact 47.

As mentioned above, the width of the card 56 is approximately equal to that of the insertion opening 76*b* so that the lead 58 of the card 56 can be certainly connected to the socket contact 47. The card 56 inserted into the insertion opening 76*b* can move in the directions A and B because of the connection part 76. Even if the card 56 moves, since a radius of the socket contact 47 is larger than the width of the lead 58, the socket contact 47 can be kept electrically connected to the lead 58.

Since the connection part 76 is made individually from the socket mold 72, there is an idle space between the card 56 and the connector 60, in other words, between the display 1 and the connector 60. Thus, a potential assembly error is absorbed in the, idle space, and the connector can be prevented from getting damage caused by the assembly error. In addition, the connector 60 in which the plug 61 and the socket 62 are coupled to each other can be attached to the display 1 and the body 2. Thus, the production lines can be made simple and the connector 60 in which the plug 61 and the socket 62 are coupled to each other can be shipped from the factory. Incidentally, the operation of the connector 60 is the same as that of the connector 30, a description thereof will be omitted.

Incidentally, unlike the above embodiment in which the connection part 76 is provided for the socket 62, the connection part may be provided for the plug 61 in addition to the plug mold 33. Moreover, it may be provided both plug 61 and the socket 62.

As mentioned above, according to the present invention, since the connection part is coupled to the connector body with an idle space, vibration and the assembly error can be absorbed therein and the connector body can be stably connected to the connection part.

Figure 18:
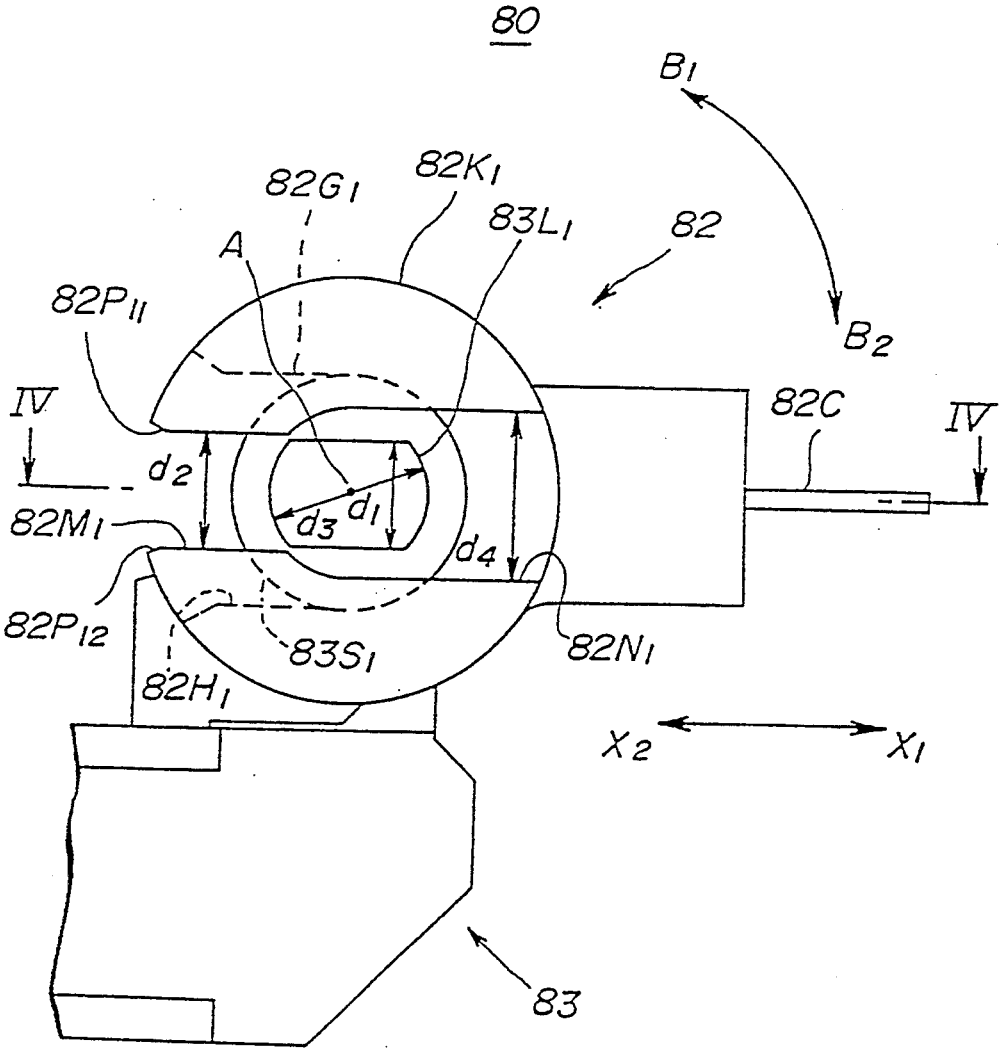
FIG. 18 shows a side view of a third embodiment according to the present invention.

FIG. 18 shows a side view of the connector 80 of the third embodiment according to the present invention.

Numeral 82 denotes a socket, and numeral 83 denotes a plug. The socket 82 has a socket contact 82C ($82C_1$, $82C_2$, $82C_3$, . . . ) and the plug 83 has a plug contact 83C ($83C_1$, $83C_2$, $83C_3$, . . . ). These contacts 82C and 83C are electrically connected in the contact connection 84 (not shown). FIG. 20 shows a sectional view taken along line III—III shown in FIG. 19.

Figure 19:
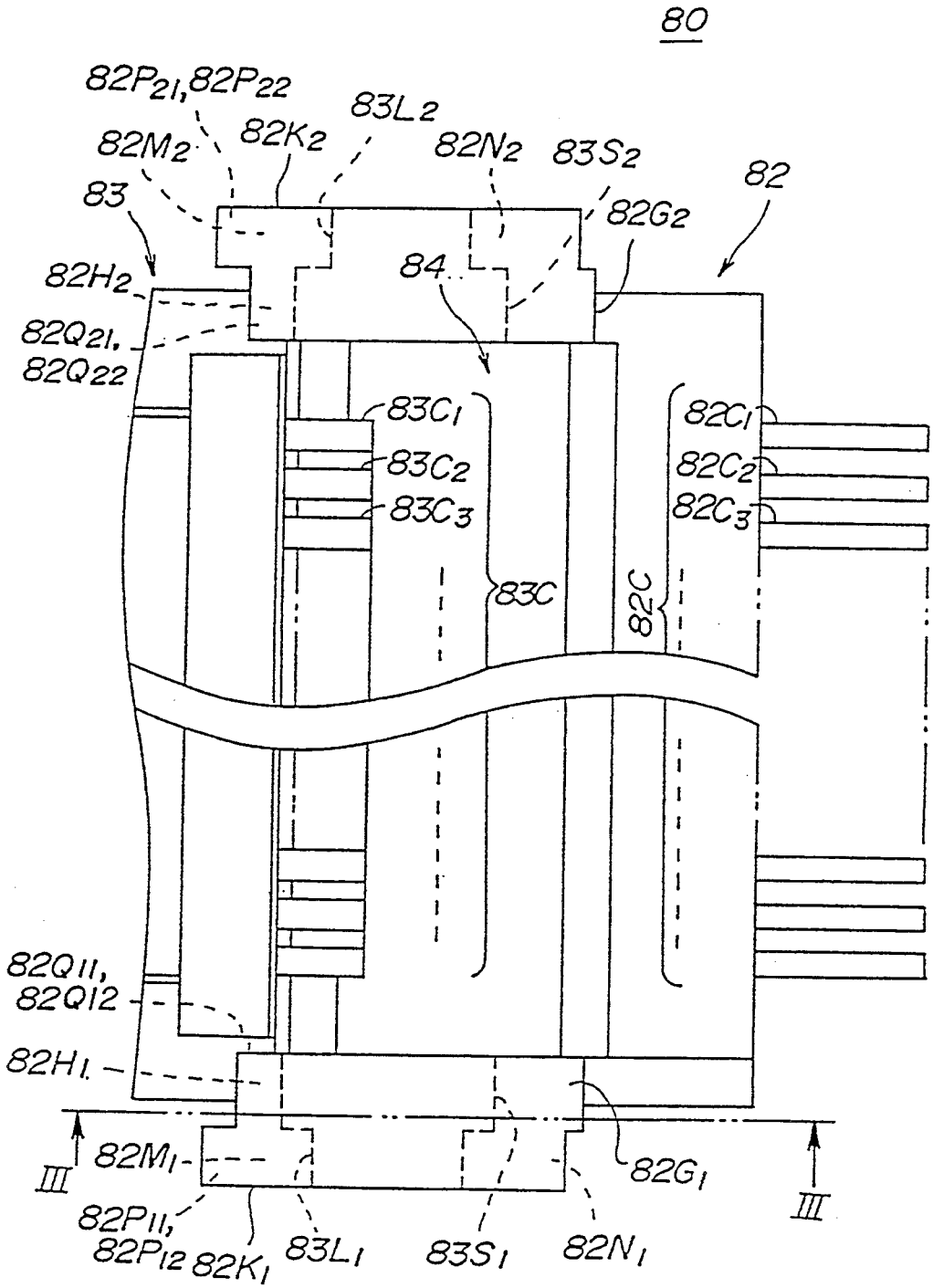
FIG. 19 shows a plan view of FIG. 18.
Figure 20:
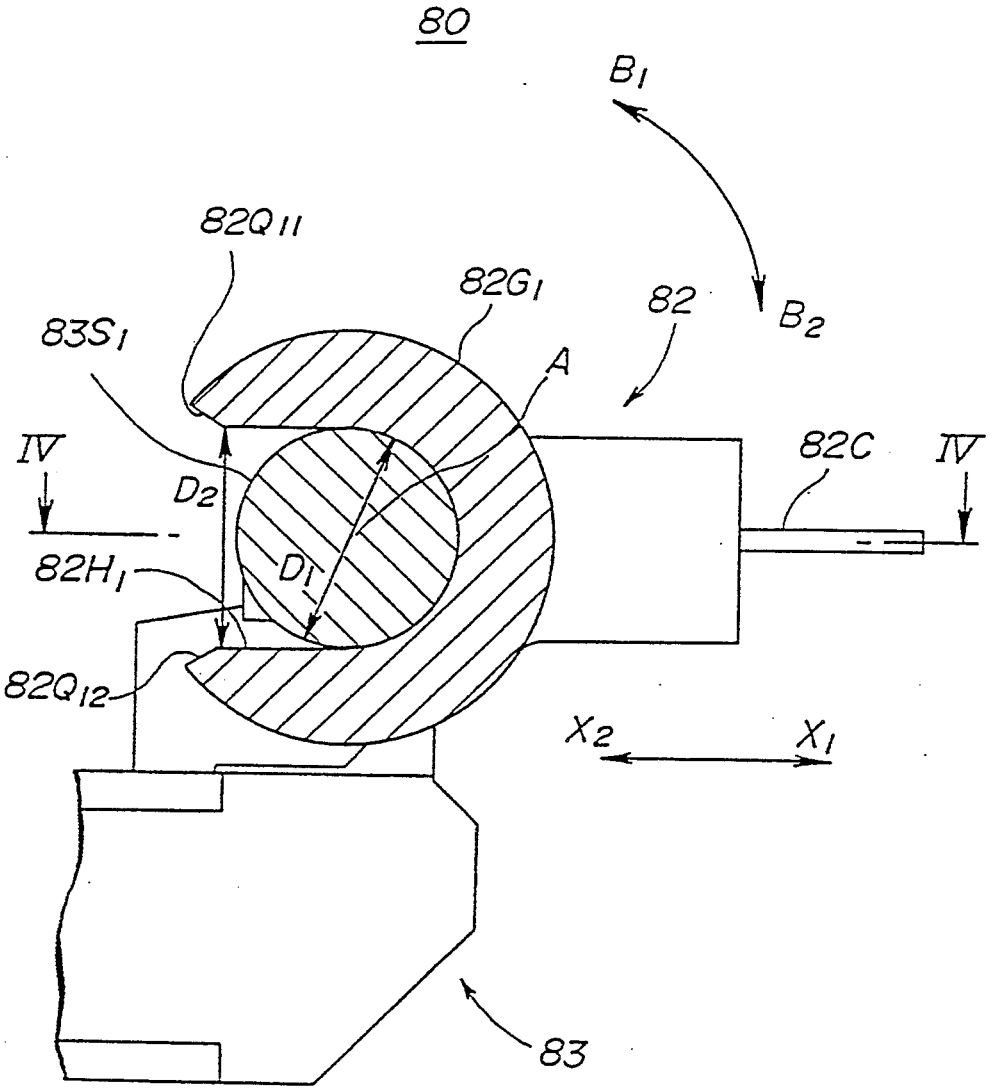
FIG. 20 shows a sectional view taken along a line III—III shown in FIG. 19.
Figure 21:
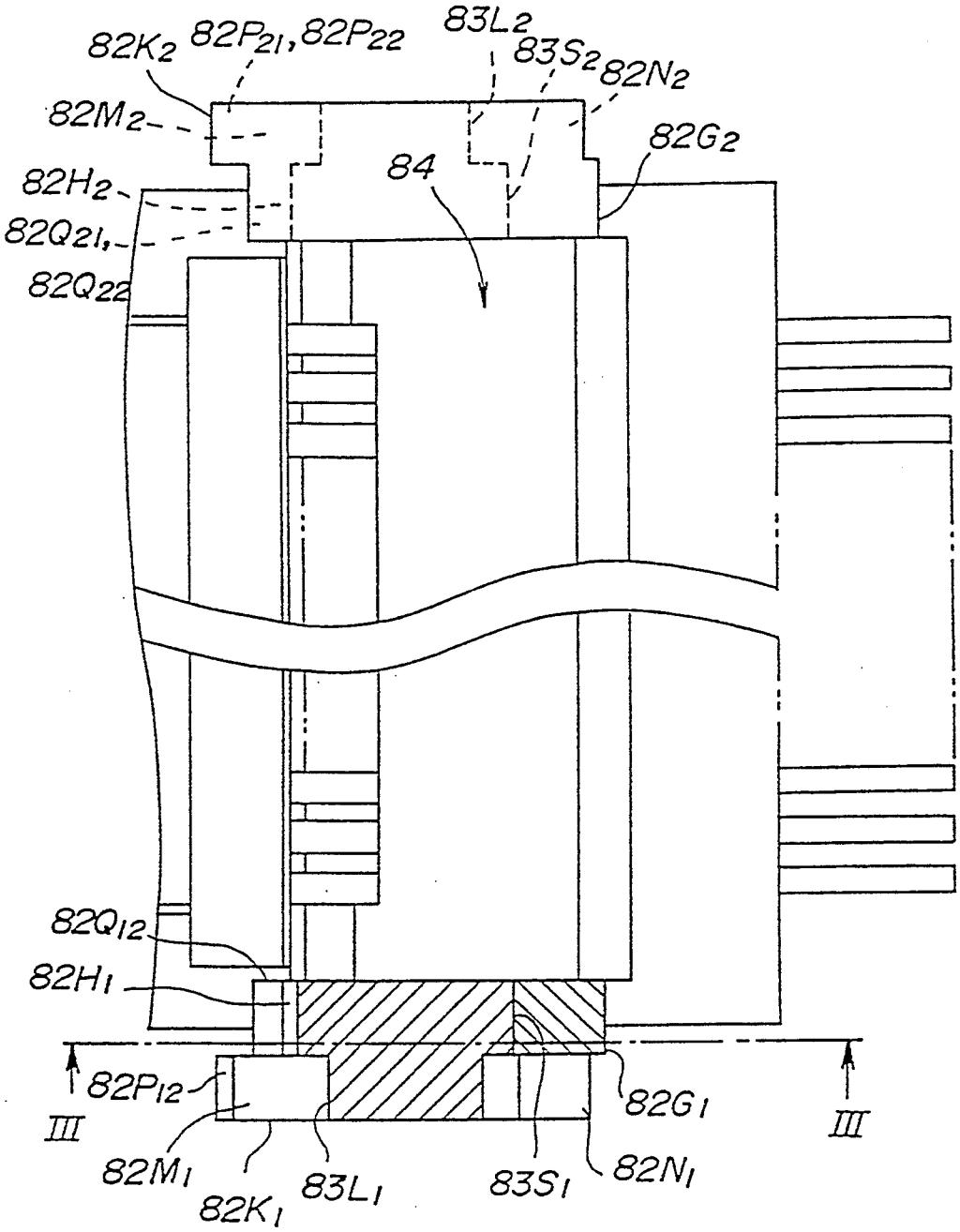
FIG. 21 shows a plan view showing a partial section of FIG. 19.

As shown in FIGS. 19 and 20, a cylindrical shaft 83S ($83S_1$, $83S_2$) having an outer radius $D_1$ at both ends of the plug 83. On the other hand, a bearing part 82G ($82G_1$, $82G_2$) having an inner diameter $D_2$ a little bit larger than the radius $D_1$ having a notch part 82H ($82H_1$, $82H_2$). The shaft 83S ($83S_1$, $83S_2$) of the plug 83 is rotatably inserted into the bearing part 82G of the socket 82 with an idle space, and the shaft 83S rotates at the center of A in the directions $B_1$ and $B_2$.

As shown in FIGS. 18 and 19, a cylindrical cam 83L ($83L_1$, $83L_2$) having diameter $d_3$ whose both ends are cut down is provided for both ends of the shaft 83S of the plug 83. Moreover, a guide 82K ($82K_1$, $82K_2$) is provided for respective both ends of the bearing part 82G of the socket 82. The guide 82K has a circular ring shape with an inner diameter $d_4$ a little bit larger than the diameter $d_3$ of the cam 83L, and has a slit 82N ($82N_1$, $82N_2$) with a width $d_4$ at the right side shown in FIG. 18 and a slit 82M ($82M_1$, $82M_2$), opposite to the slit 82N, with a width $d_2$ a little bit larger than the width $d_1$ at a part in which an upper and lower ends are cut in the cam 83L.

Incidentally, since each corner of edges 82P ($82P_{11}$, $82P_{12}$, $82P_{21}$ and $82P_{22}$) and 82Q ($82Q_{11}$, $82Q_{12}$, $82Q_{21}$ and $82Q_{22}$) are located at the notch part 82H and the slit 82M of the guide 82K of the bearing part 82G of the socket 82 are eliminated, the socket 82 can be inserted into the plug 83 and ejected therefrom without getting damaged.

Figure 22:
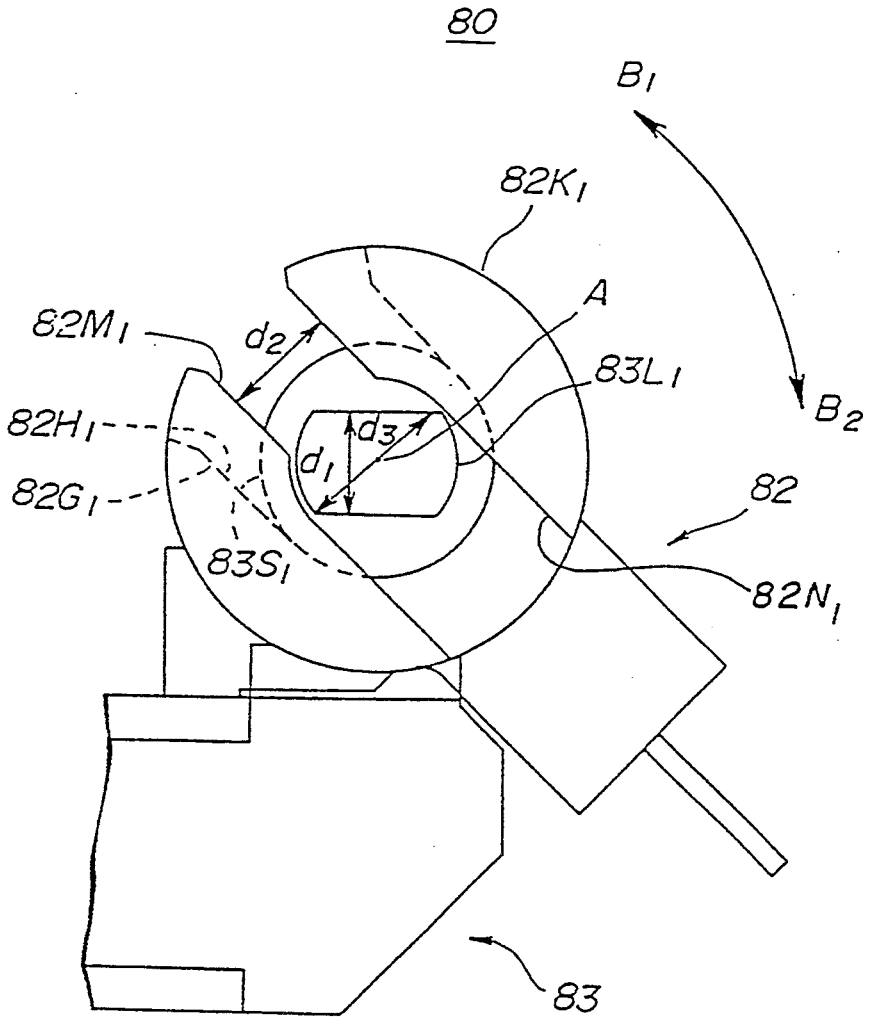
FIG. 22 shows a view of a condition in which a different relative angle exists between the plug and the socket shown in FIG. 18.

In the above connector 80, a relative angle between the socket 82 and the plug 83 is predetermined as shown in FIGS. 18 and 22. The socket 82 and the plug 83 is mutually separated by moving the socket 82 in the direction $X_1$ and moving the plug 83 in the direction $X_2$. In addition, the socket 82 and the plug 83 can be made to engage with each other by moving the socket 82 and plug 83 in the directions opposite to each other.

As shown in FIG. 18, since the width $d_1$ of the cam 83L of the plug 83 is somewhat less than the width $d_2$ of the slit 82M of the guide 82K, the cam 83L can be engaged with and separated from the guide 82K via the slit 82M of the guide 82K by respectively moving the guide 82K and the cam 83L in the directions $X_1$ and $X_2$ opposite to $X_1$.

As shown in FIG. 20, the diameter $D_1$ of the shaft 83S of the plug 83 is larger than the diameter $D_2$ of the notch part 82H of the bearing part 82G of the socket 82. Therefore, the shaft 83S can be engaged with and separated from the bearing part 82G via the notch part 82H of the bearing part 82G by respectively moving the bearing part 82G and the shaft 83S in the direction $X_1$ and $X_2$.

FIG. 22 is similar to FIG. 18 and shows a condition in which the socket 82 is rotated for the plug 83 in the direction $B_2$ by 45°.

In a case where the socket 82 and the plug 83 make a relative angle therebetween as shown in FIG. 22, the width of the cam 83L is equal to the width $d_3$, which is larger than the width $d_2$ of the slit 82M of the guide 82K opposite to the cam 83L. Therefore, in this case, the cam 83L cannot be inserted/ejected via the slit 82M of the guide 82K. That is, the cam can be inserted/ejected only when the width of the cam 83L becomes $d_1$ opposite to the slit 82M of the guide 82K.

Incidentally, the shape of the cam 83L is not limited to the above embodiment where the cam 83L exhibits the shape of a cylinder with two longitudinal truncated sections. By changing the shape of the cam 83L, the relative angle and a kind of angles in which the socket 82 and the plug 83 can be mutually engaged/ejected can be changed. For example, in a case where the cam in which two symmetrical parts are cut down is used like this embodiment, the engageable/ejectable angle can be freely established.

The present invention is not limited to the above embodiment in which the plug 83 has the shaft 83S and the cam 83L and the socket 82 has the bearing part 82G and the guide 82K. For example, the socket 82 may have the shaft 83S and the cam 83L and the plug 83 may have the bearing part 82G and the guide 82K.

As mentioned above, according to the present invention, since the socket and the plug can be mutually engaged/ejected in a predetermined relative angle, a personal computer can be producted by assembling a display and the body. Thus, the production line can be effectively improved. In addition, since a part of the personal computer, for example, only the display can be exchanged, the number of application parts can be increased.

Figure 23:
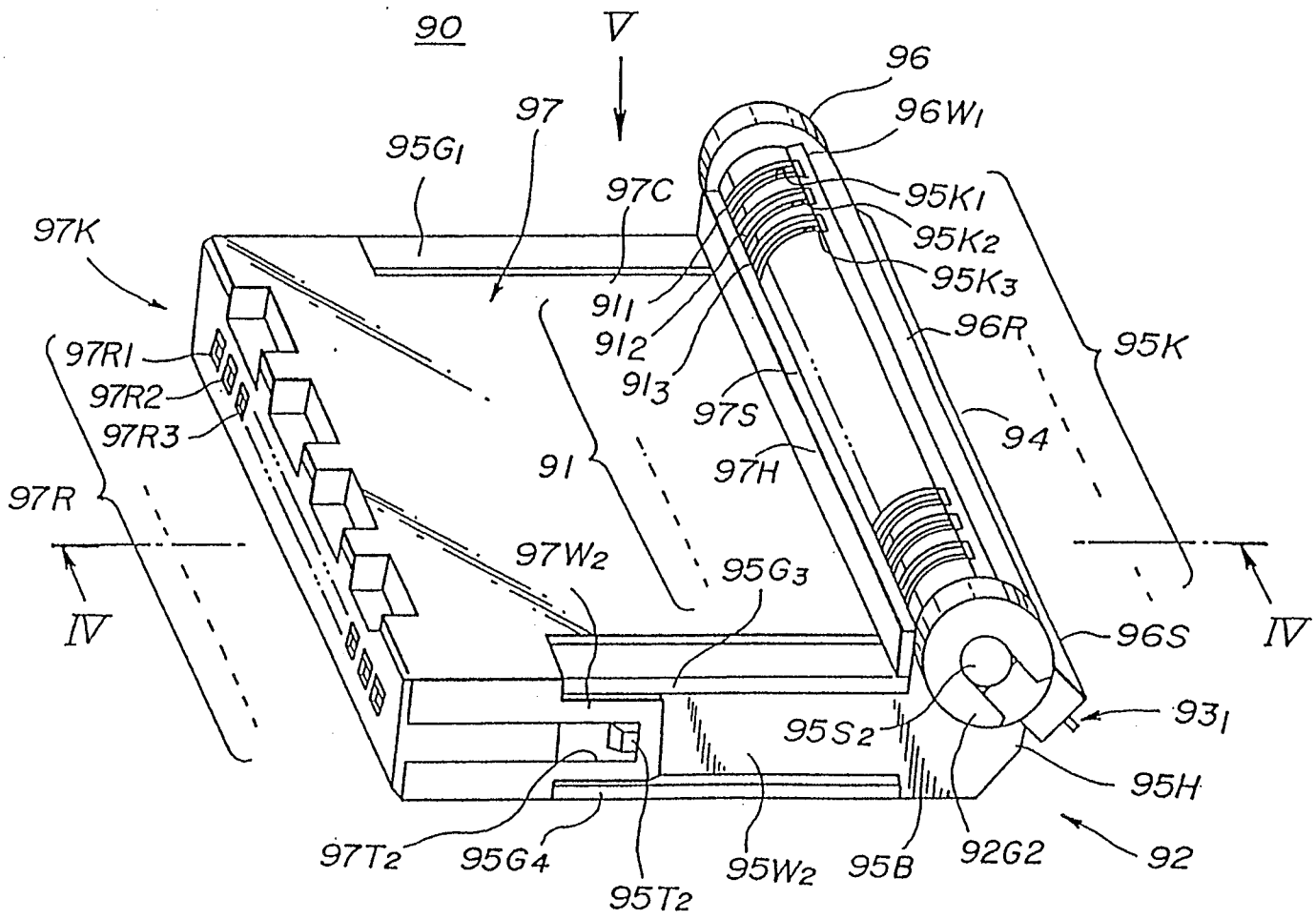
FIG. 23 shows a perspective view of a fourth embodiment according to the present invention.
Figure 24:
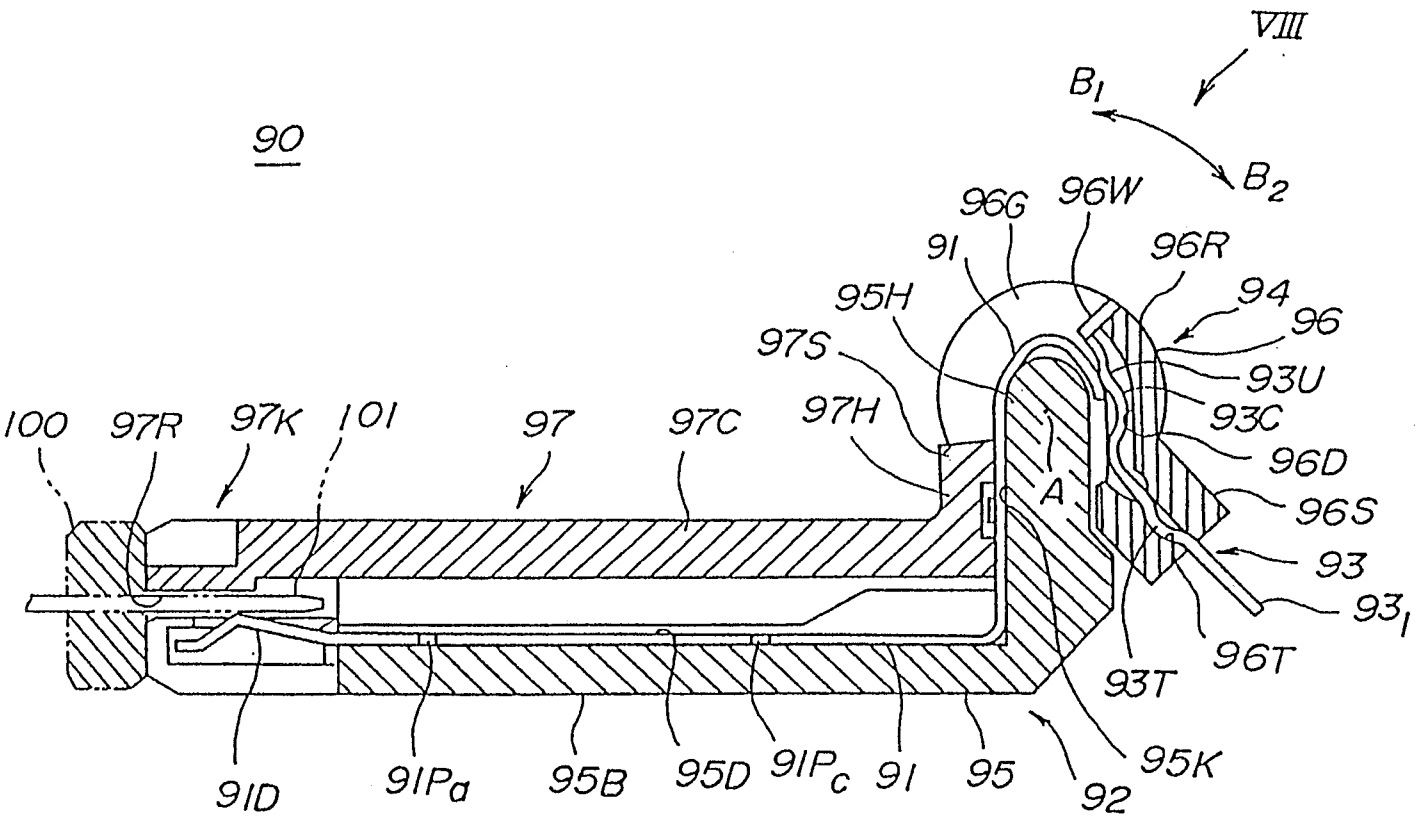
FIG. 24 shows a sectional view taken along a line IV—IV shown in FIG. 23.

FIG. 23 shows a perspective view of the connector 90 of the fourth embodiment according to the present invention. FIG. 24 shows a sectional view taken line IV—IV shown in FIG. 23.

The connector 90 comprises, as shown in FIGS. 23 and 24, two plug molds 95, a socket mold 96, a plurality of plug contacts 91 ($91_1$, $91_2$, $91_3$, . . . ), a plurality of socket contacts 93 ($93_1$, $93_2$, $93_3$, . . . ) and a contact cover 97. The plug molds 95 are rotatably coupled with each other. The plug contacts 91 are attached to the plug molds 95. The socket contacts 93 are attached to the socket molds 96. The left side of the plug contacts 91 are covered with the contact cover 97. Hereupon, the plug mold 95 and the plug contact 91 are combined and referred to as a plug 92. The socket mold 96 and the socket contact 93 are combined and referred to as a socket 94.

Each plug mold 95, the socket mold 96 and the contact cover 97 are made of insulating synthetic resin.

Figure 25:
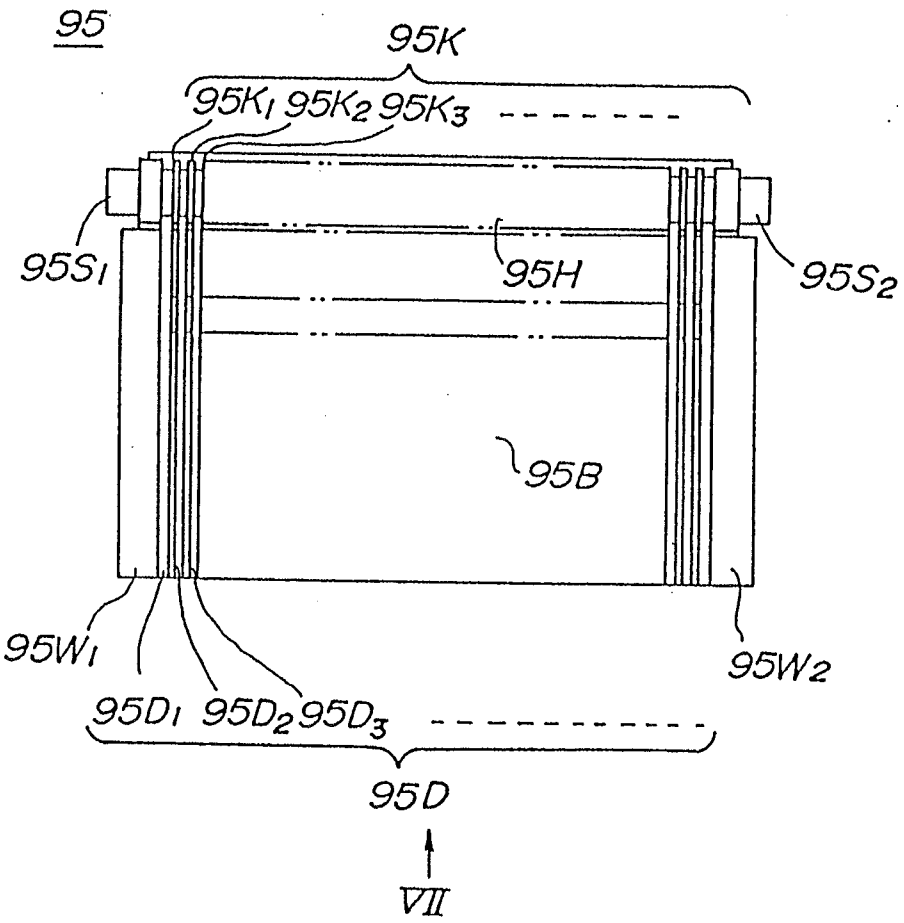
FIG. 25 shows a plan view of a plug mold of a fourth embodiment according to the present invention.
Figure 26:
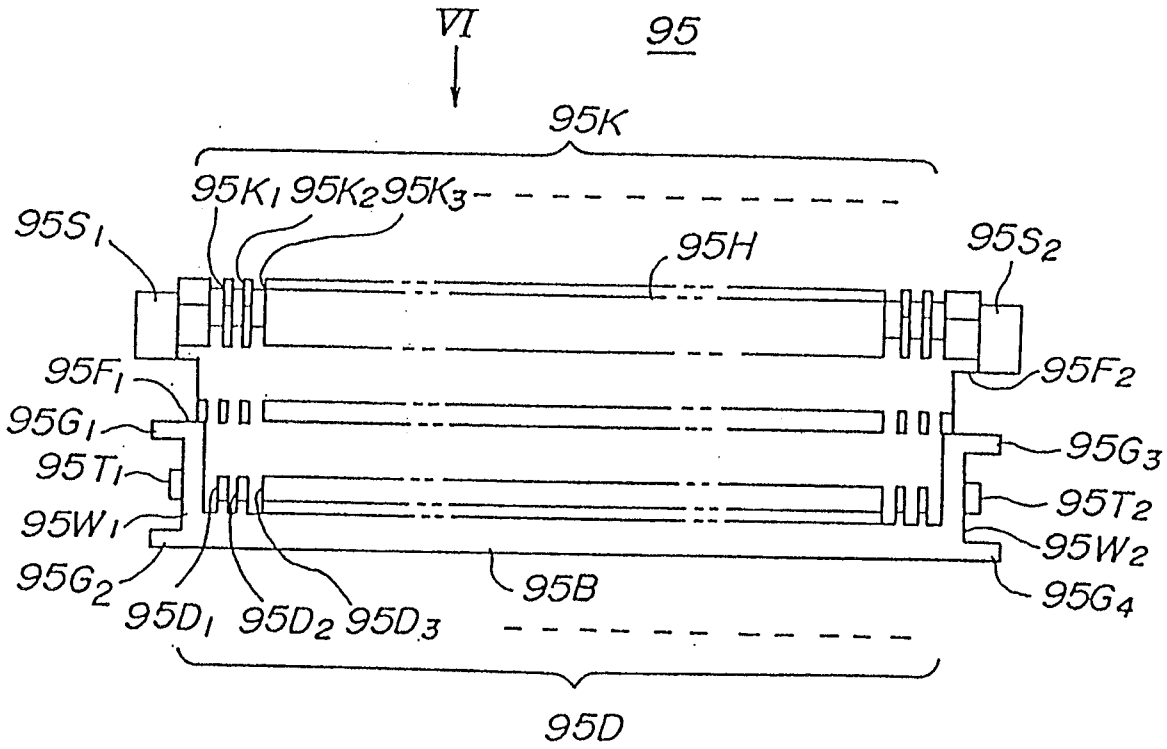
FIG. 26 shows a front view of the plug mold of FIG. 25 viewed from a direction VII.
Figure 27:
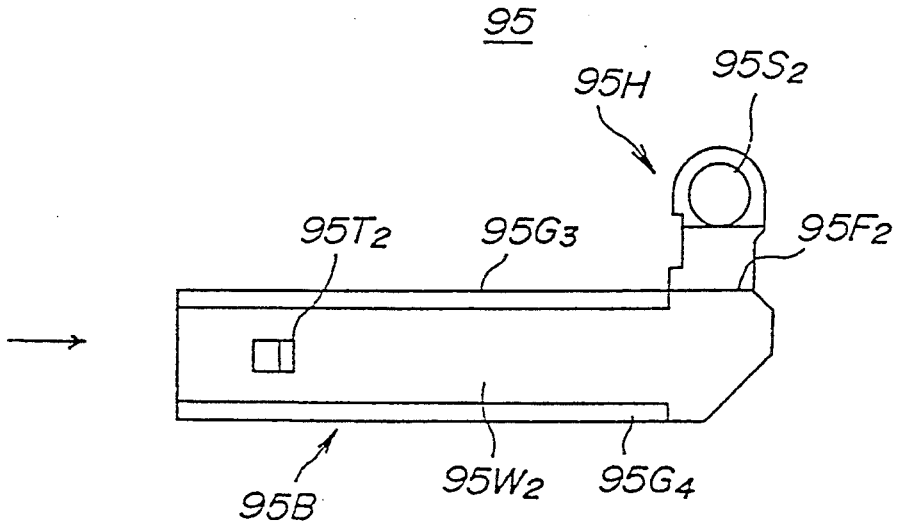
FIG. 27 shows a side view of the plug mold of the fourth embodiment according to the present invention.

FIG. 25 shows a plan view of the plug mold 95. FIG. 26 shows a front view of the FIG. 25 viewed from a direction IIV. FIG. 27 is a side view of the FIG. 25 viewed from the right.

The plug mold 95 comprises an approximately rectangular bottom part 95B, a right projection part 95H shown in FIG. 24, right and left wall parts 95W ($95W_1$, $95W_2$) shown in FIG. 26. The projection part 95H of the plug mold 95 is provided for the right end of the bottom part 95B. The projection part 95H has a wall shape with a width equal to the bottom part 95B.

A guiding groove 95D ($95D_1$, $95D_2$, $95D_3$, . . . ) is provided on the surface of the bottom part 95B, a guiding groove 95K ($95K_1$, $95K_2$, $95K_3$, . . . ) is provided on the surface of the projection part 95H in order to guide the plug contact 91. The cylindrical shaft 95S ($95S_1$, $95S_2$) projects at right and left sides of the projection part 95H. The guide 95G ($95G_1$, $95G_2$, $95G_3$, $95G_4$) is provided at the upper and lower part of the outer surface of the side wall part 95W. A tab part 95T ($95T_1$, $95T_2$) is provided at the left side shown in FIG. 23. An arm guiding groove 95F ($95F_1$, $95F_2$) is provided under both left and right ends of the shaft 95S of the projection part 95H.

Figure 28:
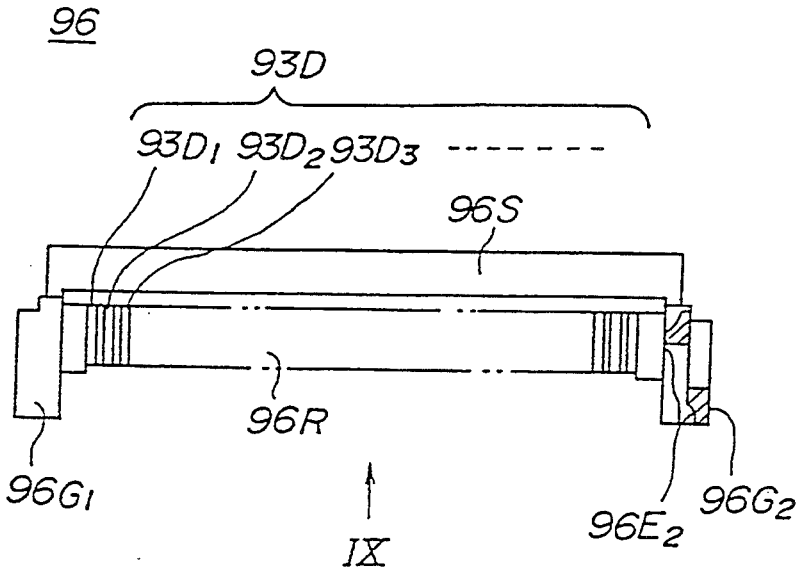
FIG. 28 shows a plan view of a socket mold of the fourth embodiment according to the present invention viewed from a direction opposite to a direction VIII shown in FIG. 24.
Figure 29:
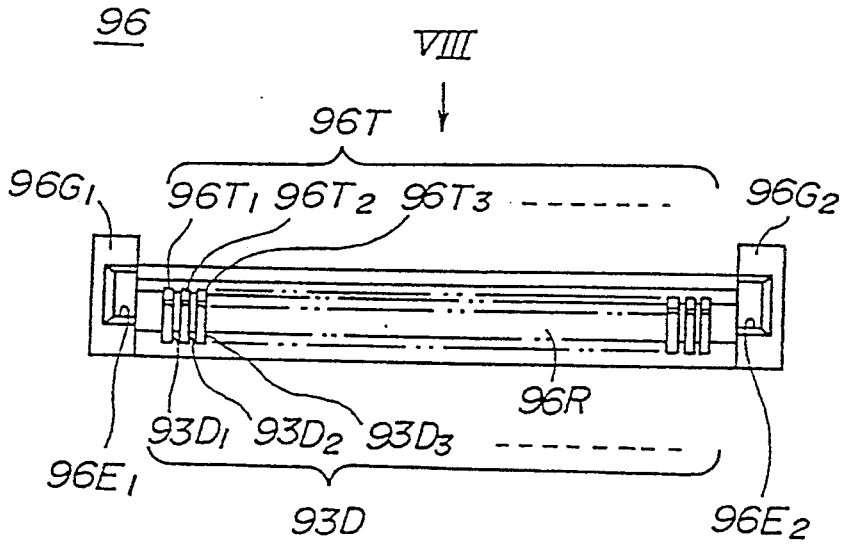
FIG. 29 shows a front view of a socket mold viewed from a direction IX shown in FIG. 28.

FIG. 28 shows a plan view of the socket mold 96 shown in FIG. 26 viewed from a direction opposite to a direction VIII, whose right side is a sectional view. FIG. 29 shows a front view of the FIG. 28 viewed from in the direction IX.

The socket mold 96 comprises, a support part 96S, curved part 96R, bearing part 96G ($96G_1$, $96G_2$). The 96S has a width approximately equal to the width of the plug mold 95. The bearing part 96G is provided at both ends of the 96R. The guide groove 96D ($96D_1$, $96D_2$) which guides the connection part 93C of the socket contact 93 is provided at the inner surface of the curved part 96R. The support hole 96T ($96T_1$, $96T_2$, $96T_3$, . . . ) which supports the right and lower part of the socket contact 93 shown in FIG. 24 is provided at the support part 93S.

Figure 30:
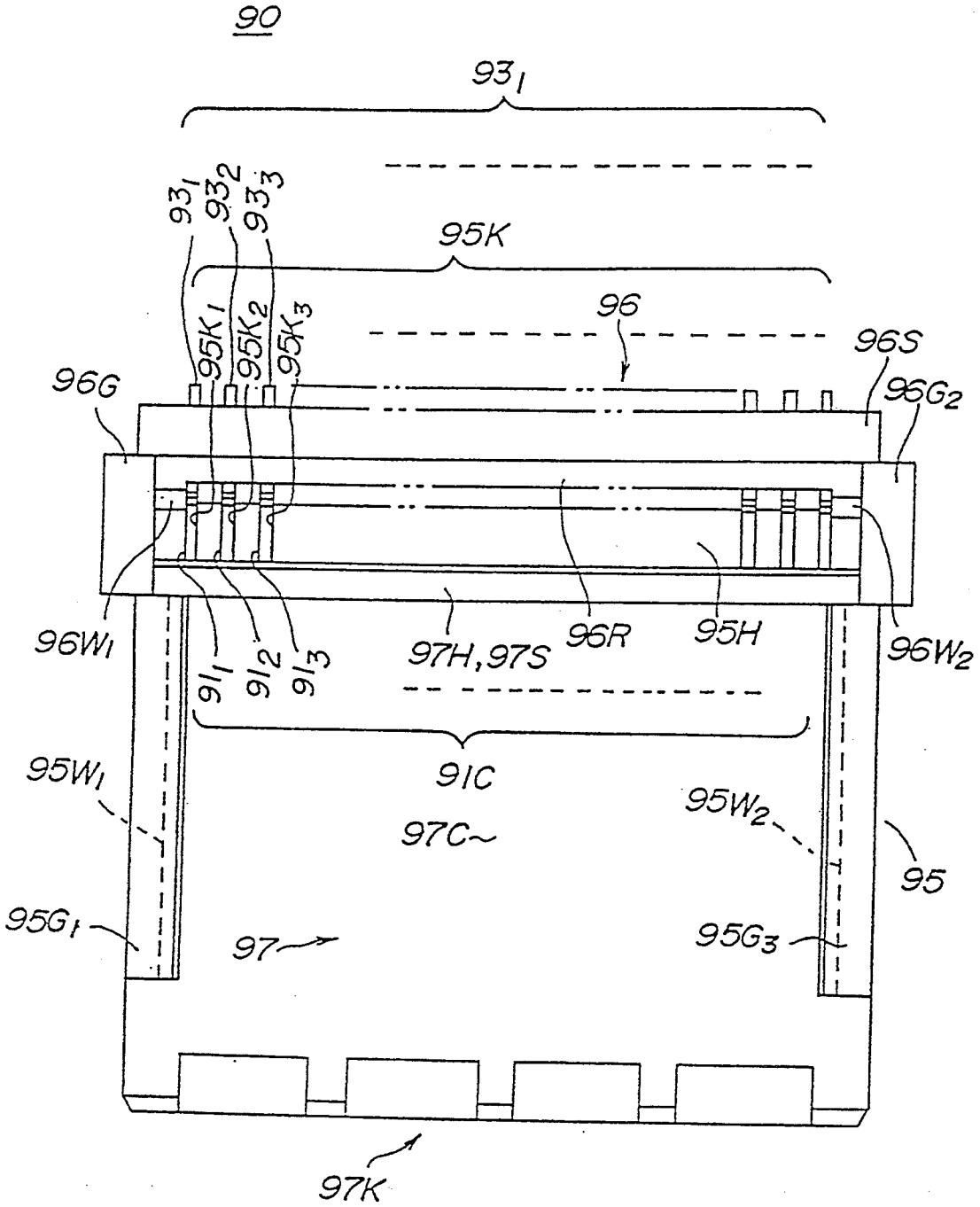
FIG. 30 shows a plan view of the fourth embodiment according to the present invention.

The bearing part 96G located at the upper end of the curved part 96R shown in FIG. 24 and at the both right and left ends shown in FIG. 30 has a spacer 96W ($96W_1$, $96W_2$) at the inner surface thereof. The lead hole 96E ($96E_1$, $96E_2$) of the shaft 95S is provided at the each lower part of the bearing part 96G shown in FIG. 28.

Figure 33:
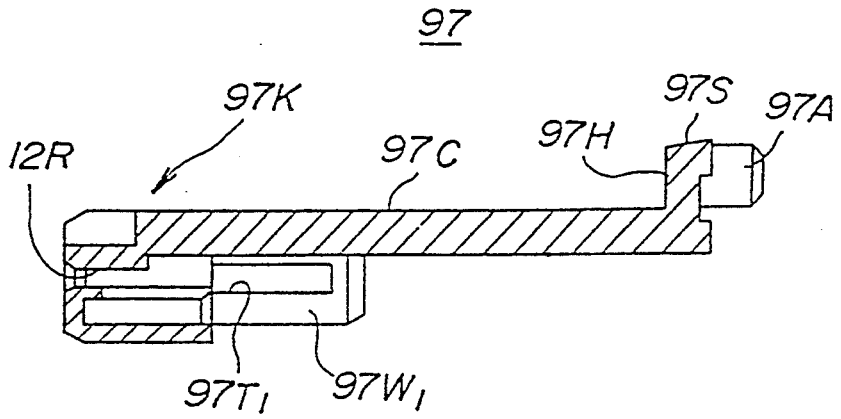
FIG. 33 shows a longitudinal section taken by a line VI—VI shown in FIG. 31.
Figure 31:
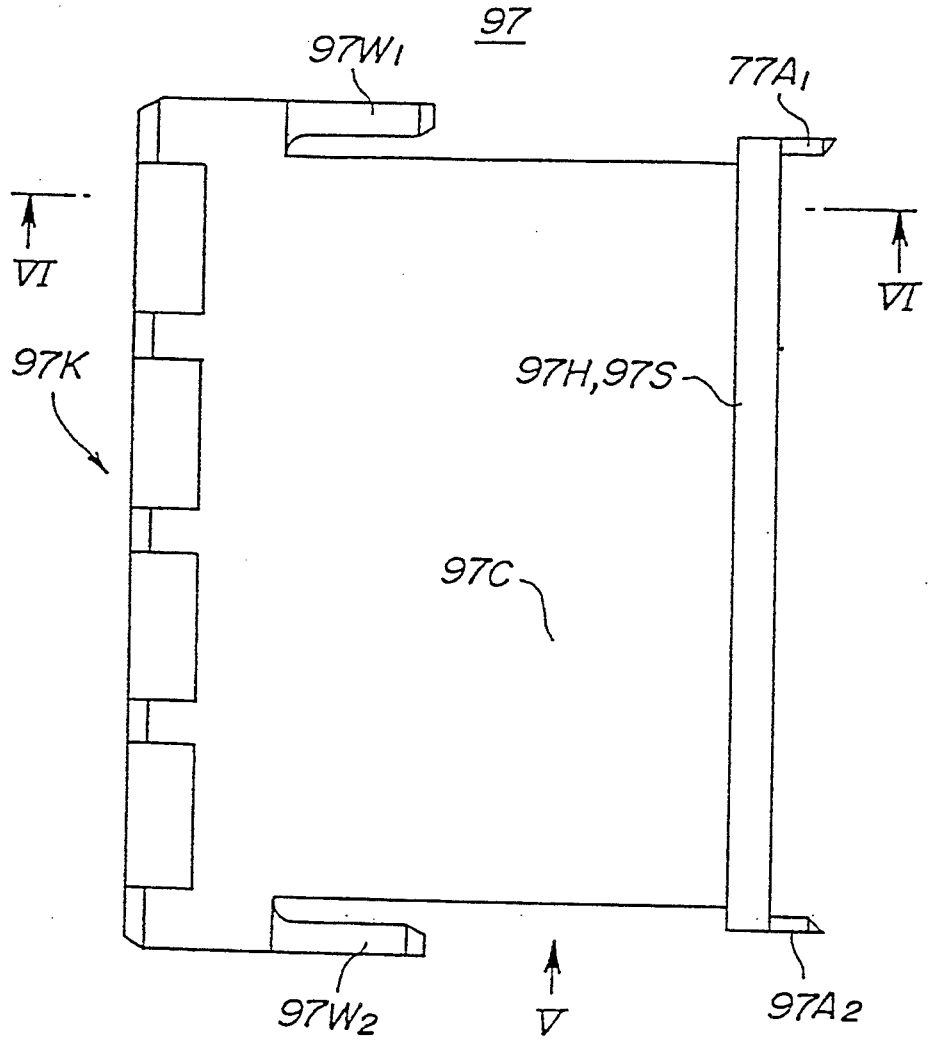
FIG. 31 shows a plan view of a contact cover of the fourth embodiment according to the present invention.
Figure 32:
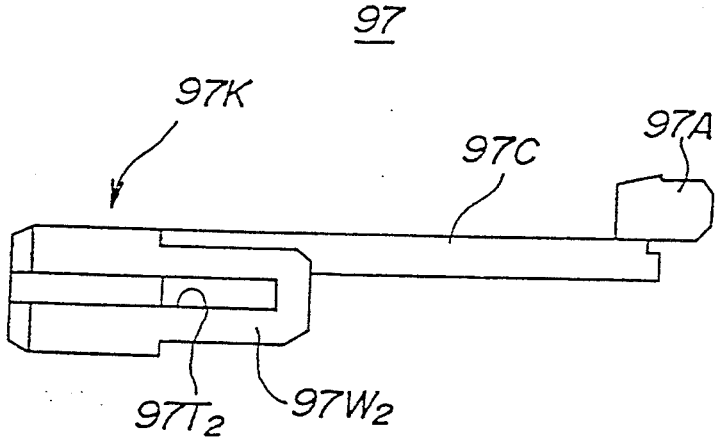
FIG. 32 shows a side view of the contact cover of FIG. 31.

FIG. 31 shows a plan view of the contact cover 97, FIG. 32 shows a side view thereof, and FIG. 33 shows a sectional view thereof.

The contact cover 97 has an approximately rectangular shape approximately equal to the bottom part 95B of the plug mold 95. The contact cover 97 has a lid part 97C which covers an end of the plug contact 91, a holder 97H, stopper 97S and an arm 97A at the right side shown in FIGS. 32 and 33, and a guide 97K at the left side therein.

The holder 97H projects to the right and upper part of the contact cover 97 shown in FIG. 24. The holder 97H has a stopper 97S at the upper end part which is obliquely cut so as to be flat. The right end of the holder 97H shown in FIG. 24 pushes and holds one end of the plug contact elongated to the left side of the projection part 95H of the plug mold.

The stopper 97S is engaged with the spacer 96W ($96W_1$, $96W_2$) provided at the both right and left ends of the socket 94 shown in FIG. 30, when the socket 94 rotates in a direction $B_1$, in order to restrict the rotating of the socket 94 in the direction $B_1$. A flat arm 97A ($97A_1$, $97A_2$) provided at each of both upper and lower ends of the holder shown in FIG. 31 and projects in the right direction shown in FIGS. 32 and 33.

The side wall part 97W ($97W_1$, $97W_2$) is formed at each of both upper and lower ends of the contact cover 97 shown in FIG. 31 and the left side shown in FIGS. 32 and 33. Each side wall part 97W has a tab hole 97T ($97T_1$, $97T_2$) having a rectangular shape elongated in the right and left direction shown in FIGS. 32 and 33 through the side wall part 97W.

Figure 34:
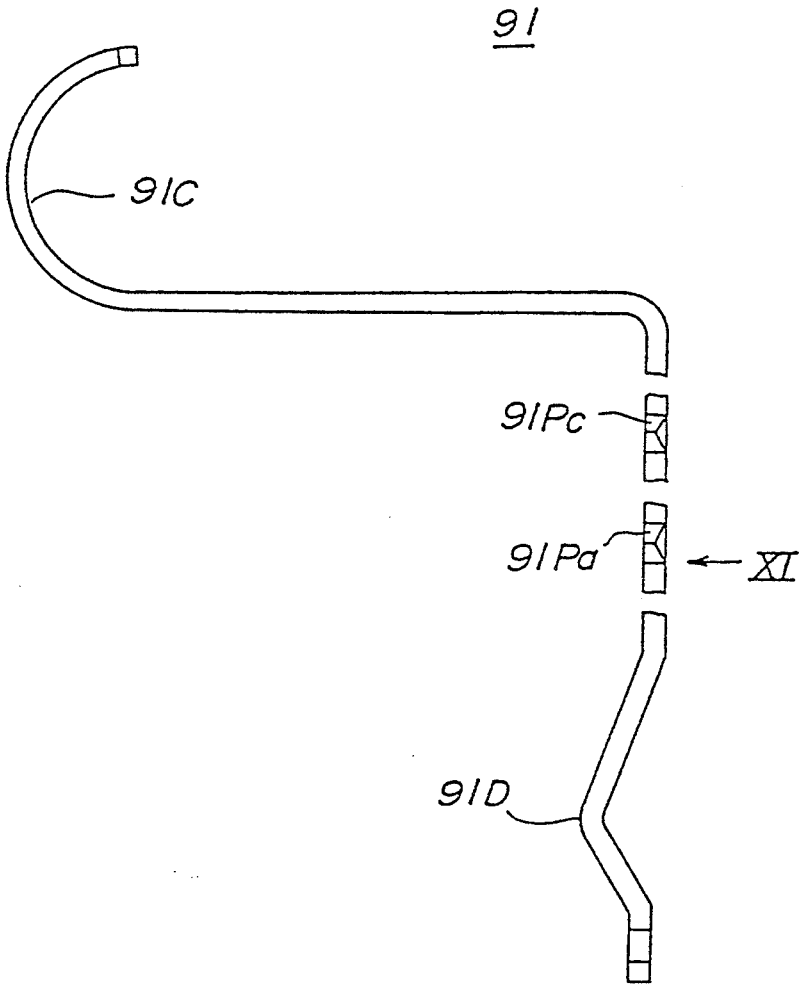
FIG. 34 a side view of the plug contact of the fourth embodiment according to the present invention.
Figure 35:
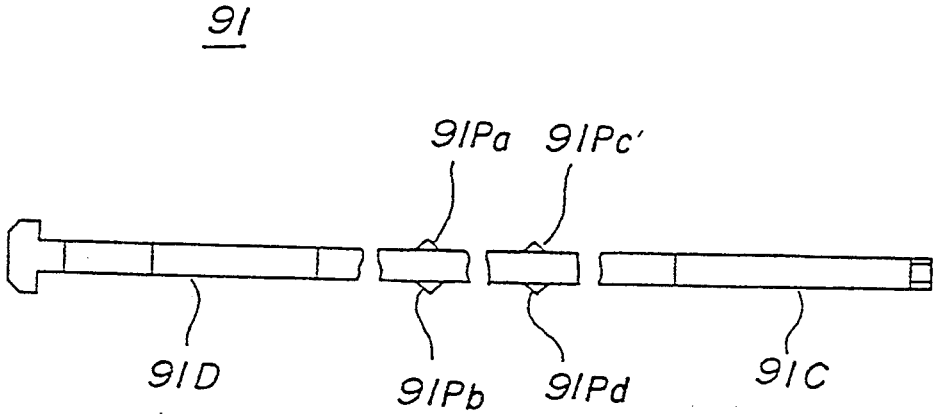
FIG. 35 shows a plan view of the plug contact of FIG. 34.
Figure 36:
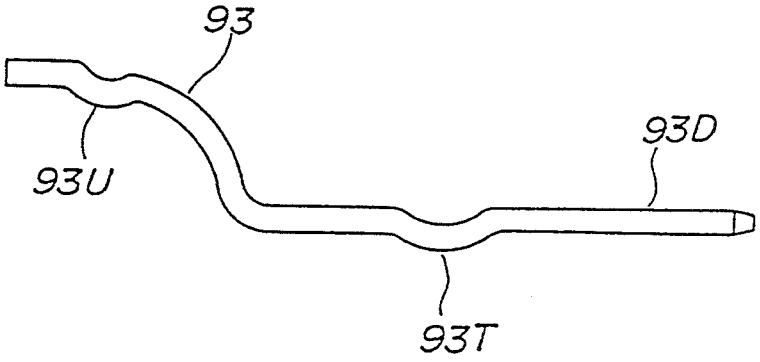
FIG. 36 shows a side view of a socket contact of the fourth embodiment according to the present invention.

FIG. 34 shows a side view of one of the plug contacts 91. FIG. 35 shows a bottom view of the FIG. 34 viewed from the direction XI. FIG. 36 shows a side view of one of the socket contacts 93. Respective plug contacts 91 and the socket contacts 93 are made of conductive metal mold, such as a copper gilding mold. The plug contact 91 and the socket contact 93 is made by bending the copper square stick as shown in FIGS. 34 to 36.

The right part of the plug contact 91 shown in FIG. 34 is bent upward so as to correspond to the projection part 95H of the plug mold 95, and the sliding connection part 91C ($91C_1$, $91C_2$, $91C_3$, . . . ) is bent and provided at the top of the right part of the plug contact 91. In addition, the external connection part 91D ($91D_1$, $91D_2$, $91D_3$, . . . ) is bent and provided at the left part of the plug contact 91 so as to project into the upper part.

Each of projecting parts 91Pa ($91Pa_1$, $91Pa_2$, $91Pa_3$, . . . ), 91Pb ($91Pb_1$, $91Pb_2$, $91Pb_3$, . . . ), 91Pc ($91Pc_1$, $91Pc_2$, $91Pc_3$, . . . ) and 91Pd ($91Pd_1$, $91Pd_2$, $91Pd_3$, . . . ), which are called as 91P in short, is provided at each of both upper and lower ends of each plug contact 91 shown in FIG. 35.

The socket contact 93 has a connection part 93C ($93C_1$, $93C_2$, $93C_3$, . . . ) with a projection part 93U. The connection part 93C is made by bending the left end part of the socket contact 93 upward, then bending in the left side, and bending the top upward. On the other hand, the projection part 93T ($93T_1$, $93T_2$, $93T_3$, . . . ) is provided for the right side of the socket contact 93.

Next, a description will be given of the assembly of the connector 90.

The plug 92 is made by inserting each plug contact 91 from the upper direction of the plug mold 95 shown in FIG. 26. This time, the plug contact 91 is fixed by inserting pressingly the projecting part 91P of the plug contact 91 into the guiding groove 95D of the stator mold 95.

The contact cover 97, as shown in FIGS. 32 and 33, is attached to the plug mold 95 from the left side of the plug mold 95 shown in FIG. 27. Incidentally, each plug contact 91 is attached to the plug in advance, but it is not indicated.

The arm 97A is inserted into the arm guiding groove 95F so as to hold both right and left ends of the projection part 97H of the plug mold 95 shown in FIGS. 26 and 30. The side wall part 97W of the contact cover 97 is pushed and enlarged by the side wall part 95W of the plug mold 95, and the tab **95*t* of the side wall 95W of the plug mold is inserted into the tab 97T**.

Because of insertion from both ends, the contact cover 97 is definitely fixed in the plug mold 95.

The holder 97H of the contact cover 97 touches the left side of the projection part 95H of the plug mold 95, as shown in FIG. 24, so that each plug contacts 91 is supported. Thus, one end of the left and lower part of the curved sliding connection part 91C, as shown in FIG. 24, is supported by the plug mold 95, so that the sliding connection part 91C serves as a flat spring.

The guide 97K is provided for the left side of the contact cover 97 shown in FIG.24 so as to cover the external connection part 91D of the plug contact 91. The guide 97K has a guide path 97R ($97R_1$, $97R_2$, $97R_3$, . . . ) at the left side thereof shown in FIG. 24, a number of which corresponds to that of the plug contacts 91.

Each of external contacts 101 ($101_1$, $101_2$, $101_3$, . . . ) corresponding to the plug contacts 91, which are engaged with external connectors 100 to be connected to the body 2 of the personal computer 3, is inserted into the groove path 97R. Incidentally, FIG. 24 shows only one of the external contacts 101. Consequently, each of the external contacts 101 is guided into the guide path 97R, and electrically connected to the plug contact 91.

Hereupon, as mentioned above, the contact cover 97 is definitely fixed in the plug mold 95 by the arm 97A and the side wall part 97W. Therefore, even if each of the external contacts 101 inserted into the guiding path 97R is suffered from the external force in the upper and lower directions in FIG. 24, the contact cover 97 is never separated from the bottom part 95B of the plug mold 95. Thus, the external contacts 101 are never separated from the external connection part 91C of the plug contact 91 to prevent the bad connection.

Incidentally, the present invention is not limited to this embodiment in which the contact cover 97 has the holder 97H, the stopper 97S, the guide 97K, and the arm 97A. Therefore, one of the holder 97H, the stopper 97S, the guide 97K, and the arm 97A may be provided for the contact cover 97. In addition, the present invention is not limited to the embodiment in which the contact cover is attached to the plug. Therefore, the contact cover may be attached to the socket, or the socket and the plug.

As mentioned above, according to the present invention, since one of the holder, the stopper, the guide, and the arm is provided for the contact cover which covers one end part of the plug contact so as not to disclose it, the contact cover itself serves as a plurality of functions.

Next, as to the socket 94, each of the socket contacts 93 is inserted from the lower direction into the socket mold 96 shown in FIG. 28. The socket contact 93 is fixed by pressingly inserting the projection part 93T of the socket contact 93 into the support holes 96T of the socket mold 96. Thus, a lower end of the connection part 93C of the socket contact 93 shown in FIG. 24 is supported by the socket mold 96, so that the connection part 96C serves as a flat spring.

The plug 92 and the socket 94, which are individually assembled and pivotally engaged with each other by enlarging the bearing part 96G provided at both ends of the curved part 96R of the socket mold 96 via the shafts 95S mounted at both ends of the projection part 95H of the plug mold 95.

Each of the external contacts 101 ($101_1$, $101_2$, $101_3$, . . . ) of the external connector 100 connected to the body 2 of the personal computer 1 via the left external connection part 97K shown in FIG. 24 is inserted into the assembled connector 90. Consequently, the external contact 101 and the flat contact 91 are electrically connected to each other via the external connection part 91D, so that the body 2 of the personal computer 3 and the plug 92 is electrically connected to each other.

Then the external connection part 93D of the socket contact 93 is connected to the display 1 of the personal computer. The socket 94 and the display 1 is electrically connected via the external connection part $93_1$.

The sliding connection part 91C and the connection part 93C of the socket contact 93 are engaged with each other, and thus the body 2 of the personal computer 3 and the display 1 is electrically connected.

A description will now be given of the operation of each connection part of the connector 90 with reference to FIGS. 37 and 38.

Figure 37:
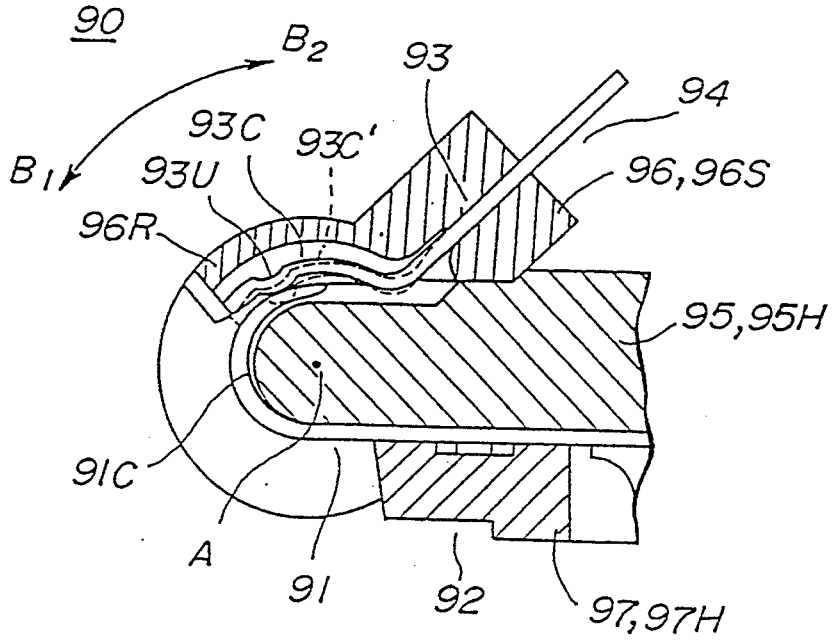
FIG. 37 shows a transverse section of a connector of the fourth embodiment according to the present invention which is used for the personal computer with the display opened.

FIG. 37 shows a condition of the personal computer 3, for which the connector 90 is used, with the display 1 opened, that is, a case where the personal computer 3 is used. FIG. 38 shows the personal computer 1 shown in FIG. 37 in which the socket 94 is rotated around the point A in the direction $B_1$ by 144°. FIG. 38 shows that the display 1 is bent and engaged with the body 2, that is, a condition of carrying a personal computer 1.

Figure 38:
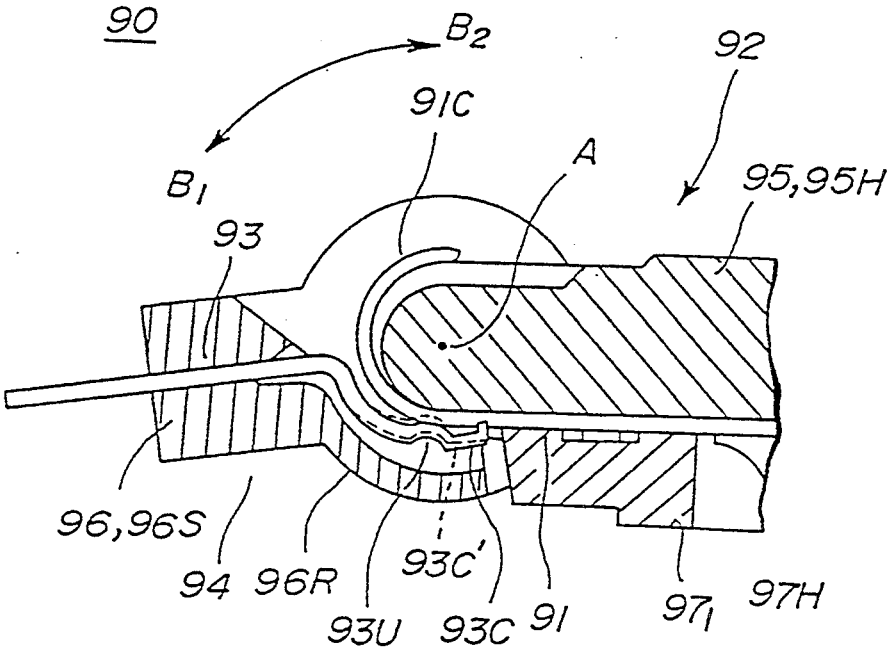
FIG. 38 shows a transverse section in which the display shown in FIG. 37 is closed.

As to the connection part 93C of the socket contact 93, as shown in FIGS. 37 and 38, the dotted line 93C' shows a condition in which the socket 94 is not engaged with the plug 92 yet, that is, no external force is applied to the connection part 93C of the socket contact 93.

As shown in FIGS. 37 and 38, the deflection amount of the connection part 93C of the socket contact 93 shown in FIG. 37 is higher than that in FIG. 38. This is because there is an offset between a center of an approximate circle of the curved sliding connection part 91C and the center A of the rotation of the socket 94 in an upward direction shown in FIG. 37. Therefore, a mutual contact pressure between the connection part 91C and the 93C caused by the elastic force of the flat spring against the deflected amount in FIG. 37 is larger. Thus, because of the contact pressure, the contacts 91 and 93 are successfully and electrically connected to each other.

Since the contact pressure in FIG. 38 is lower than that in FIG. 37, the bad electrical connection may occur. However, since FIG. 38 shows a carrying condition and no electrical connection is needed, the bad electrical connection will never occur.

As to the sliding connection part 91C of the plug contact 91, like the connection part 93C of the socket contact 93, the deflection amount in FIG. 37 is higher than that in FIG. 38. Therefore, because of the flat spring effect of the connection part 91C and the contact pressure of the socket contact 93, in a condition shown in FIG. 37 in which the mutual contact pressure between the connection parts 91C and 93C is increased, while in a condition shown in FIG. 38 in which the personal computer is carried, the contact pressure can be lowered.

As a result, when the personal computer is used the electrical connection can be proper, and when it is not used the contact pressure is made small in order to minimize the abrasion of the connection part.

Figure 39:
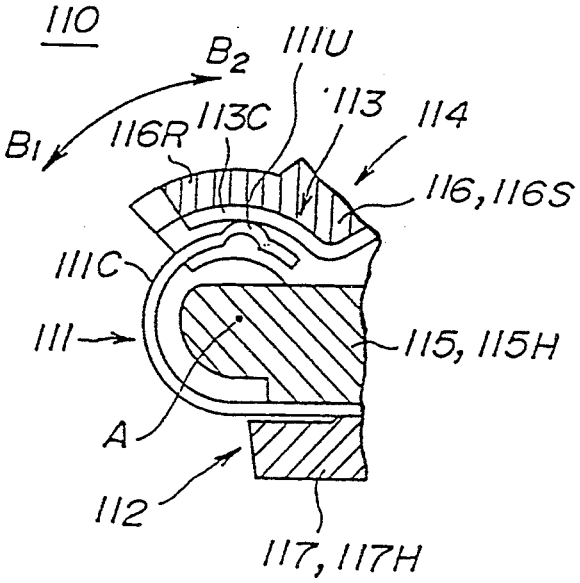
FIG. 39 shows a transverse section of a connector of a fifth embodiment according to the present invention which is used for the personal computer with the display opened.
Figure 40:
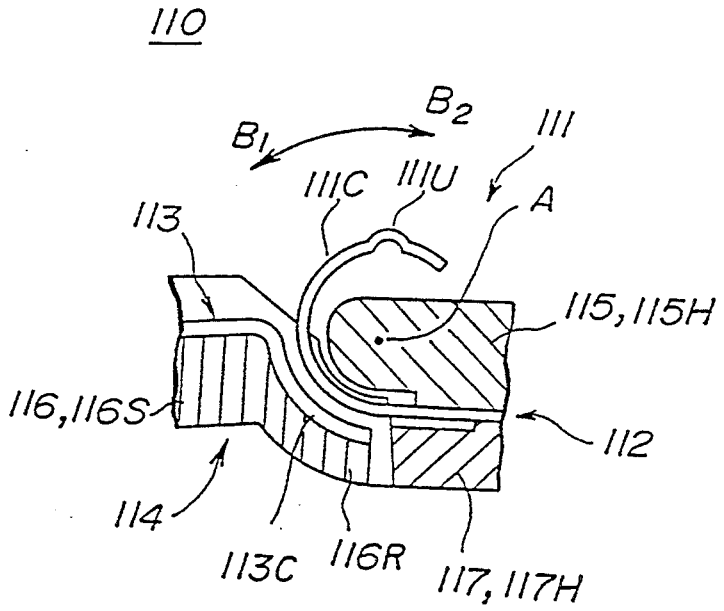
FIG. 40 shows a longitudinal section in which the display shown in FIG. 39 is closed.

FIGS. 39 and 40 respectively show sectional views of the connector 110 of the fifth embodiment according to the present invention. FIG. 39 corresponds to FIG. 37 and FIG. 40 corresponds to FIG. 38, respectively. That is, FIG. 39 shows a condition where the personal computer 1 is used, and FIG. 40 shows a condition where the personal computer is carried.

The connector 110 of the fifth embodiment serves as a flat spring like the connection part 91C of the plug contact 91 of the connector 90 since a lower end of the connection part 111C of the plug contact 111 shown in FIG. 39 is supported by the plug mold 115. A projection part 111 U is provided in the vicinity of the top of the connection part 111C by bending the connection part 111.

The connection part 113C of the socket contact 113 is bent and fixed in the inner surface of the curved part 116R of the socket mold 116. Therefore, the connection part 113C does not act as the flat spring.

In the connector 110, the projection part 111U of the plug contact 111 is connected with the connection part 111C of the socket contact 113 when the personal computer is used, as shown in FIG. 39, and they are separated when the personal computer is carried, as shown in FIG. 40. Since they are mutually separated while the personal computer is carried, the abrasion at the connection part can be minimized. In addition, since a position of the projection part 111U on the plug contact 111 can be changed in accordance with the number of the contacts of the plugs and the socket, the relative angle between the socket 114 and the plug 112 can be changed in accordance with the number of the plug and the sockets. Incidentally, in the above fourth and fifth embodiments, the plug contact and the socket contact may be replaced with each other.

As mentioned above, according to the present invention, a space requisite for the connection part comprising the connection part of the plug contact and that of the socket contact can be small by bending the connection part of the contact as an approximate semicircle in the circumferential direction, and additionally the flat spring effect of each connection part can be maintained. Therefore, the performance of the connection part can be maintained, the connector can be miniaturized, and the personal computer using such a connector can be miniaturized.

Further, the present invention is not limited to these preferred embodiments, but various variations and modifications may be made without departing from the scope of the present invention.

What is claimed is:

1. A connector which electrically connects a first external element to a second external element, said connector comprising:

a first member;

a second member, rotatably engaged with said first member;

a first contact, attached to said first member, which includes two end parts, one end part of said first contact being electrically connectable to the first external element, and the other end part of said first contact being located to touch said second member, and said other end part being so elastic that, if an attempt is made to rotate said second member against the other end part of said first contact after said second member touches the other end part of said first contact, said second member can be rotated while the other end part of said first contact is compressed on said second member; and a second contact, attached to said second member, which includes two end parts, one end part of said second contact being opposite to the other end part of said first contact and electrically connected to the same while the other end part of said first contact is compressed on said second member, and the other end part of said second contact including a free end which is electrically connectable to the second external element;

said first member including a rotating center around which said second member rotates, said other end part of said first contact having a first arc shape and being substantially located between the rotating center and said second member.

2. A connector according to claim 1, wherein said one end part of said second contact has a second arc shape whose center corresponds to the rotating center of said first member, and a center of the first arc shape of the other end part of said first contact does not correspond to the rotating center of said first member, so that a compression force of the other end part of said first contact against said second member varies in accordance with a rotating position of said second member.

3. A connector according to claim 1, wherein said other end part of said first contact includes a projecting part which projects toward said second member, the other end part of said first contact compressing said second member only at the projecting part thereof, so that said one end part of said second contact is electrically connectable to only the projecting part of the other end part of said first contact.

4. A connector according to claim 1, wherein said second member includes a connecting portion in which the other end part of said second contact is located, the second external element being inserted into and ejected from the connecting portion of said second member, and the connecting portion being of such a size that the second external element can minutely move therein so as to be properly connected to the other end part of said second contact.

5. A connector according to claim 4, wherein said connecting portion is further defined as formed to receive a second external element comprising a card edge with connectors.

6. A connector according to claim 1, further comprising a connecting member having a through perforation, said connecting member being attached to said second member while the other end part of said second contact is inserted into the through perforation thereof, the second external element being inserted into the through perforation of said connecting member to be connected to the other end part of said second contact, and wherein the through perforation of said connecting member fits the second external element so that the second external element can be completely fixed therein, and said connecting member is attached to said second member loosely enough to move minutely so that the other end part of said second contact can be properly connected to the second external element.

7. A connector according to claim 6, wherein said connecting member is further defined as formed to receive a second external element comprising a card edge with connectors in said through perforation.

8. A connector according to claim 1, wherein said second member can be separated from said first member when said second member is located at a predetermined arcuate position.

9. A connector according to claim 8, wherein said first member has a first connecting part and said second member has a second connecting part engageable with the first connecting part, said second member rotating around said first member via the first and second connecting parts, and wherein the second connecting part includes:

a rotating hole having a circular section with respect to a first surface, the circular section having a predetermined radius and a rotating center around which said second member rotates; and a guide hole, coupled to the rotating hole, which includes a section, with respect to the first surface, having a shape defined by cutting a circle having the predetermined radius along chords parallel to a diameter of the circle, and wherein the first connecting part of said first member has approximately the same sectional shape, with respect to the first surface, as the guide hole of second connecting part, the first connecting part of said first member being inserted into the rotating hole of the second connecting part via the guide hole and located at said rotating hole while said second contact rotates with said second member.

10. A connector which electrically connects a first external element to a second external element, said connector comprising:

a first member;

a second member, rotatably engaged with said first member;

a first contact, attached to said first member, which includes two end parts, one end part of said first contact being electrically connectable to the first external element, and the other end part of said first contact being located to touch said second member, and said other end part being so elastic that, if an attempt is made to rotate said second member against the other end part of said first contact after said second member touches the other end part of said first contact, said second member can be rotated while the other end part of said first contact is compressed on said second member;

a second contact, attached to said second member, which includes two end parts, one end part of said second contact being opposite to the other end part of said first contact and electrically connected to the same while the other end part of said first contact is compressed on said second member, and the other end part of said second contact including a free end which is electrically connectable to the second external element; and a contact cover engaged with said first member so as to protect said first contact.

11. A connector according to claim 10, wherein said contact cover includes a projecting part for blocking rotational movement of said second member with respect to said first member at a predetermined point and determining the arcuate movement of said second member.

12. A connector according to claim 10, wherein said contact cover includes a connecting portion into which said one end part of said first contact and the first external element are inserted so as to be connected to each other.

13. A connector according to claim 10, wherein said second member can be separated from said first member when said second member is located at a predetermined arcuate position.

14. A connector according to claim 13, wherein said first member has a first connecting part and said second member has a second connecting part engageable with the first connecting part, said second member rotating around said first member via the first and second connecting parts, and wherein the second connecting part includes:

a rotating hole having a circular section with respect to a first surface, the circular section having a predetermined radius and a rotating center around which said second member rotates; and a guide hole, coupled to the rotating hole, which includes a section, with respect to the first surface, having a shape defined by cutting a circle having the predetermined radius along chords parallel to a diameter of the circle, and wherein the first connecting part of said first member has approximately the same sectional shape, with respect to the first surface, as the guide hole of the second connecting part, the first connecting part of said first member being inserted into the rotating hole of the second connecting part via the guide hole and located at said rotating hole while said second contact rotates with said second member.

* * * * *